United States Patent [19]

Konno

[11] Patent Number: 4,486,745

[45] Date of Patent: Dec. 4, 1984

[54] PATTERN GENERATING APPARATUS CAPABLE OF GENERATING PATTERNS BY CONTROLLING BASIC SYMBOLS

[75] Inventor: Akira Konno, Sayama, Japan

[73] Assignee: Canon Kabushiki Kaisha, Tokyo, Japan

[21] Appl. No.: 306,361

[22] Filed: Sep. 28, 1981

[30] Foreign Application Priority Data

Oct. 3, 1980 [JP] Japan ..... 55-138327

[51] Int. Cl.[3] ..... G09G 1/16

[52] U.S. Cl. ..... 340/734; 340/727; 340/735

[58] Field of Search ..... 340/734, 735, 727, 723

[56] References Cited

U.S. PATENT DOCUMENTS

| | | | |
|---|---|---|---|
| 4,271,476 | 6/1981 | Lotspeich | 340/727 |
| 4,283,723 | 8/1981 | Bickley et al. | 340/723 |
| 4,291,305 | 9/1981 | Kimura et al. | 340/734 |

*Primary Examiner*—Marshall M. Curtis

*Attorney, Agent, or Firm*—Fitzpatrick, Cella, Harper & Scinto

[57] ABSTRACT

A pattern generating apparatus produces a large plurality of form patterns from a much smaller plurality of basic form symbols. These basic symbols are stored in a memory and are accessed in different ways so that as output from the memory each basic symbol may be rotated by varying degrees. In each of its rotated configurations each basic symbol thereby represents a different pattern.

28 Claims, 37 Drawing Figures

| n | $A_2$ | $B_2$ | $B_2/A_2$ |
|---|---|---|---|
| 2 | 6 | 16 | 2.67 |
| 3 | 35 | 81 | 2.31 |
| 4 | 130 | 256 | 1.97 |
| 5 | 357 | 625 | 1.75 |
| 6 | 806 | 1295 | 1.61 |

FIG. 5

| n | $A_1$ | $B_1$ | $B_1/A_1$ |
|---|---|---|---|
| 2 | 6 | 16 | 2.67 |
| 3 | 21 | 67 | 3.19 |
| 4 | 52 | 178 | 3.42 |
| 5 | 105 | 373 | 3.55 |
| 6 | 186 | 675 | 3.63 |

FIG. 6

FIG. 16A

LONGITUDINAL MODE CLOCK NO.

| LONGITUDINAL MODE READOUT SCANNING NO. | $C_0$ | $C_1$ | $C_2$ | $C_3$ | $C_4$ | $C_5$ | $C_6$ | $C_7$ | $C_8$ | $C_9$ | $C_{10}$ | $C_{11}$ | $C_{12}$ | $C_{13}$ | $C_{14}$ | $C_{15}$ |
|---|---|---|---|---|---|---|---|---|---|---|---|---|---|---|---|---|
| $\ell_0$ | 0 | 0 | 0 | 0 | 0 | 0 | 0 | 0 | 0 | 0 | 0 | 0 | 0 | 0 | 0 | 0 |
| $\ell_1$ | 0 | 0 | 0 | 0 | 0 | 0 | 0 | 0 | 0 | 0 | 0 | 0 | 0 | 0 | 0 | 0 |
| $\ell_2$ | 0 | 0 | 0 | 0 | 0 | 0 | 0 | 0 | 0 | 0 | 0 | 0 | 0 | 0 | 0 | 0 |
| $\ell_3$ | 0 | 0 | 0 | 0 | 0 | 0 | 0 | 0 | 0 | 0 | 0 | 0 | 0 | 0 | 0 | 0 |
| $\ell_4$ | 0 | 0 | 0 | 0 | 0 | 0 | 0 | 0 | 0 | 0 | 0 | 0 | 0 | 0 | 0 | 0 |
| $\ell_5$ | 0 | 0 | 0 | 0 | 0 | 0 | 0 | 0 | 0 | 0 | 0 | 0 | 0 | 0 | 0 | 0 |
| $\ell_6$ | 0 | 0 | 0 | 0 | 0 | 0 | 0 | 0 | 0 | 0 | 0 | 0 | 0 | 0 | 0 | 0 |
| $\ell_7$ | 0 | 0 | 0 | 0 | 0 | 0 | 0 | 0 | 0 | 0 | 0 | 0 | 0 | 0 | 0 | 0 |
| $\ell_8$ | 0 | 0 | 0 | 0 | 0 | 0 | 0 | 0 | 0 | 0 | 0 | 0 | 0 | 0 | 0 | 0 |
| $\ell_9$ | 0 | 0 | 0 | 0 | 0 | 0 | 0 | 0 | 0 | 0 | 0 | 0 | 0 | 0 | 0 | 0 |
| $\ell_{10}$ | 0 | 0 | 0 | 0 | 0 | 0 | 0 | 0 | 0 | 1 | 1 | 1 | 1 | 1 | 1 | 1 |
| $\ell_{11}$ | 0 | 0 | 0 | 0 | 0 | 0 | 0 | 0 | 0 | 1 | 1 | 1 | 1 | 1 | 1 | 1 |
| $\ell_{12}$ | 0 | 0 | 0 | 0 | 0 | 0 | 0 | 0 | 0 | 1 | 1 | 0 | 0 | 0 | 0 | 0 |
| $\ell_{13}$ | 0 | 0 | 0 | 0 | 0 | 0 | 0 | 0 | 0 | 1 | 1 | 0 | 0 | 0 | 0 | 0 |
| $\ell_{14}$ | 0 | 0 | 0 | 0 | 0 | 0 | 0 | 0 | 0 | 1 | 1 | 0 | 0 | 0 | 0 | 0 |
| $\ell_{15}$ | 0 | 0 | 0 | 0 | 0 | 0 | 0 | 0 | 0 | 1 | 1 | 0 | 0 | 0 | 0 | 0 |
| $\ell_{16}$ | 0 | 0 | 0 | 0 | 0 | 0 | 0 | 0 | 0 | 1 | 1 | 0 | 0 | 0 | 0 | 0 |
| $\ell_{17}$ | 0 | 0 | 0 | 0 | 0 | 0 | 0 | 0 | 0 | 1 | 1 | 0 | 0 | 0 | 0 | 0 |
| $\ell_{18}$ | 0 | 0 | 0 | 0 | 0 | 0 | 0 | 0 | 0 | 1 | 1 | 1 | 1 | 1 | 1 | 1 |
| $\ell_{19}$ | 0 | 0 | 0 | 0 | 0 | 0 | 0 | 0 | 0 | 1 | 1 | 1 | 1 | 1 | 1 | 1 |
| $\ell_{20}$ | 0 | 0 | 0 | 0 | 0 | 0 | 0 | 0 | 0 | 1 | 1 | 0 | 0 | 0 | 0 | 0 |
| $\ell_{21}$ | 0 | 0 | 0 | 0 | 0 | 0 | 0 | 0 | 0 | 1 | 1 | 0 | 0 | 0 | 0 | 0 |
| $\ell_{22}$ | 0 | 0 | 0 | 0 | 0 | 0 | 0 | 0 | 0 | 1 | 1 | 0 | 0 | 0 | 0 | 0 |
| $\ell_{23}$ | 0 | 0 | 0 | 0 | 0 | 0 | 0 | 0 | 0 | 1 | 1 | 0 | 0 | 0 | 0 | 0 |
| $\ell_{24}$ | 0 | 0 | 0 | 0 | 0 | 0 | 0 | 0 | 0 | 1 | 1 | 0 | 0 | 0 | 0 | 0 |
| $\ell_{25}$ | 0 | 0 | 0 | 0 | 0 | 0 | 0 | 0 | 0 | 1 | 1 | 0 | 0 | 0 | 0 | 0 |
| $\ell_{26}$ | 0 | 0 | 0 | 0 | 0 | 0 | 0 | 0 | 0 | 1 | 1 | 0 | 0 | 0 | 0 | 0 |
| $\ell_{27}$ | 0 | 0 | 0 | 0 | 0 | 0 | 0 | 0 | 0 | 1 | 1 | 0 | 0 | 0 | 0 | 0 |
| $\ell_{28}$ | 0 | 0 | 0 | 0 | 0 | 0 | 0 | 0 | 0 | 0 | 0 | 0 | 0 | 0 | 0 | 0 |
| $\ell_{29}$ | 0 | 0 | 0 | 0 | 0 | 0 | 0 | 0 | 0 | 0 | 0 | 0 | 0 | 0 | 0 | 0 |
| $\ell_{30}$ | 0 | 0 | 0 | 0 | 0 | 0 | 0 | 0 | 0 | 0 | 0 | 0 | 0 | 0 | 0 | 0 |
| $\ell_{31}$ | 0 | 0 | 0 | 0 | 0 | 0 | 0 | 0 | 0 | 0 | 0 | 0 | 0 | 0 | 0 | 0 |
| | $\ell_0$ | $\ell_1$ | $\ell_2$ | $\ell_3$ | $\ell_4$ | $\ell_5$ | $\ell_6$ | $\ell_7$ | $\ell_8$ | $\ell_9$ | $\ell_{10}$ | $\ell_{11}$ | $\ell_{12}$ | $\ell_{13}$ | $\ell_{14}$ | $\ell_{15}$ |

LATERAL MODE READOUT SCANNING NO.

FIG. 16B

| $C_{16}$ | $C_{17}$ | $C_{18}$ | $C_{19}$ | $C_{20}$ | $C_{21}$ | $C_{22}$ | $C_{23}$ | $C_{24}$ | $C_{25}$ | $C_{26}$ | $C_{27}$ | $C_{28}$ | $C_{29}$ | $C_{30}$ | $C_{31}$ | |
|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | $C_{31}$ |
| 0 | 0 | 0 | 0 | 0 | 0 | 0 | 0 | 0 | 0 | 0 | 0 | 0 | 0 | 0 | 0 | $C_{30}$ |
| 0 | 0 | 0 | 0 | 0 | 0 | 0 | 0 | 0 | 0 | 0 | 0 | 0 | 0 | 0 | 0 | $C_{29}$ |
| 0 | 0 | 0 | 0 | 0 | 0 | 0 | 0 | 0 | 0 | 0 | 0 | 0 | 0 | 0 | 0 | $C_{28}$ |
| 0 | 0 | 0 | 0 | 0 | 0 | 0 | 0 | 0 | 0 | 0 | 0 | 0 | 0 | 0 | 0 | $C_{27}$ |
| 0 | 0 | 0 | 0 | 0 | 0 | 0 | 0 | 0 | 0 | 0 | 0 | 0 | 0 | 0 | 0 | $C_{26}$ |
| 0 | 0 | 0 | 0 | 0 | 0 | 0 | 0 | 0 | 0 | 0 | 0 | 0 | 0 | 0 | 0 | $C_{25}$ |
| 0 | 0 | 0 | 0 | 0 | 0 | 0 | 0 | 0 | 0 | 0 | 0 | 0 | 0 | 0 | 0 | $C_{24}$ |
| 0 | 0 | 0 | 0 | 0 | 0 | 0 | 0 | 0 | 0 | 0 | 0 | 0 | 0 | 0 | 0 | $C_{23}$ |
| 0 | 0 | 0 | 0 | 0 | 0 | 0 | 0 | 0 | 0 | 0 | 0 | 0 | 0 | 0 | 0 | $C_{22}$ |
| 1 | 1 | 1 | 1 | 1 | 0 | 0 | 0 | 0 | 0 | 0 | 0 | 0 | 0 | 0 | 0 | $C_{21}$ |
| 1 | 1 | 1 | 1 | 1 | 1 | 0 | 0 | 0 | 0 | 0 | 0 | 0 | 0 | 0 | 0 | $C_{20}$ |
| 0 | 0 | 0 | 0 | 1 | 1 | 0 | 0 | 0 | 0 | 0 | 0 | 0 | 0 | 0 | 0 | $C_{19}$ |
| 0 | 0 | 0 | 0 | 0 | 1 | 1 | 0 | 0 | 0 | 0 | 0 | 0 | 0 | 0 | 0 | $C_{18}$ |
| 0 | 0 | 0 | 0 | 0 | 1 | 1 | 0 | 0 | 0 | 0 | 0 | 0 | 0 | 0 | 0 | $C_{17}$ |
| 0 | 0 | 0 | 0 | 0 | 1 | 1 | 0 | 0 | 0 | 0 | 0 | 0 | 0 | 0 | 0 | $C_{16}$ |
| 0 | 0 | 0 | 0 | 0 | 1 | 1 | 0 | 0 | 0 | 0 | 0 | 0 | 0 | 0 | 0 | $C_{15}$ |
| 0 | 0 | 0 | 0 | 0 | 1 | 0 | 0 | 0 | 0 | 0 | 0 | 0 | 0 | 0 | 0 | $C_{14}$ |
| 1 | 1 | 1 | 1 | 1 | 1 | 0 | 0 | 0 | 0 | 0 | 0 | 0 | 0 | 0 | 0 | $C_{13}$ |
| 1 | 1 | 1 | 1 | 1 | 0 | 0 | 0 | 0 | 0 | 0 | 0 | 0 | 0 | 0 | 0 | $C_{12}$ |
| 0 | 0 | 0 | 0 | 0 | 0 | 0 | 0 | 0 | 0 | 0 | 0 | 0 | 0 | 0 | 0 | $C_{11}$ |
| 0 | 0 | 0 | 0 | 0 | 0 | 0 | 0 | 0 | 0 | 0 | 0 | 0 | 0 | 0 | 0 | $C_{10}$ |
| 0 | 0 | 0 | 0 | 0 | 0 | 0 | 0 | 0 | 0 | 0 | 0 | 0 | 0 | 0 | 0 | $C_9$ |
| 0 | 0 | 0 | 0 | 0 | 0 | 0 | 0 | 0 | 0 | 0 | 0 | 0 | 0 | 0 | 0 | $C_8$ |
| 0 | 0 | 0 | 0 | 0 | 0 | 0 | 0 | 0 | 0 | 0 | 0 | 0 | 0 | 0 | 0 | $C_9$ |
| 0 | 0 | 0 | 0 | 0 | 0 | 0 | 0 | 0 | 0 | 0 | 0 | 0 | 0 | 0 | 0 | $C_6$ |
| 0 | 0 | 0 | 0 | 0 | 0 | 0 | 0 | 0 | 0 | 0 | 0 | 0 | 0 | 0 | 0 | $C_5$ |
| 0 | 0 | 0 | 0 | 0 | 0 | 0 | 0 | 0 | 0 | 0 | 0 | 0 | 0 | 0 | 0 | $C_4$ |
| 0 | 0 | 0 | 0 | 0 | 0 | 0 | 0 | 0 | 0 | 0 | 0 | 0 | 0 | 0 | 0 | $C_3$ |
| 0 | 0 | 0 | 0 | 0 | 0 | 0 | 0 | 0 | 0 | 0 | 0 | 0 | 0 | 0 | 0 | $C_2$ |
| 0 | 0 | 0 | 0 | 0 | 0 | 0 | 0 | 0 | 0 | 0 | 0 | 0 | 0 | 0 | 0 | $C_1$ |
| 0 | 0 | 0 | 0 | 0 | 0 | 0 | 0 | 0 | 0 | 0 | 0 | 0 | 0 | 0 | 0 | $C_0$ |
| $\ell_{16}$ | $\ell_{17}$ | $\ell_{18}$ | $\ell_{19}$ | $\ell_{20}$ | $\ell_{21}$ | $\ell_{22}$ | $\ell_{23}$ | $\ell_{24}$ | $\ell_{25}$ | $\ell_{26}$ | $\ell_{27}$ | $\ell_{28}$ | $\ell_{29}$ | $\ell_{30}$ | $\ell_{31}$ | |

LATERAL MODE CLOCK NO.

| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 54 | 27 | 55 | 0 | 0 | 0 | 0 | 0 | 0 | 0 | 0 | 0 |
| 0 | 0 | 0 | 0 | 0 | 0 | 0 | 0 | 56 | 28 | 57 | 0 | 0 | 0 | 0 | 0 | 0 | 0 | 0 | 0 |
| 0 | 1 | 1 | 0 | 0 | 0 | 1 | 1 | 58 | 29 | 59 | 0 | 1 | 1 | 0 | 0 | 1 | 1 | 0 | 0 |
| 0 | 0 | 0 | 0 | 0 | 0 | 0 | 0 | 60 | 30 | 61 | 0 | 0 | 0 | 0 | 0 | 0 | 0 | 0 | 0 |
| 0 | 0 | 0 | 0 | 0 | 0 | 0 | 0 | 62 | 31 | 63 | 0 | 0 | 0 | 0 | 0 | 0 | 0 | 0 | 0 |
| 0 | 0 | 0 | 0 | 0 | 0 | 0 | 0 | 64 | 32 | 65 | 0 | 0 | 0 | 0 | 0 | 0 | 0 | 0 | 0 |
| 0 | 0 | 0 | 0 | 0 | 0 | 0 | 0 | 66 | 33 | 67 | 0 | 0 | 0 | 0 | 0 | 0 | 0 | 0 | 0 |
| 0 | 1 | 1 | 0 | 0 | 1 | 1 | 0 | 68 | 34 | 69 | 1 | 1 | 1 | 0 | 1 | 1 | 1 | 0 | 0 |
| 0 | 0 | 0 | 0 | 0 | 0 | 0 | 0 | 70 | 35 | 71 | 1 | 1 | 1 | 1 | 1 | 1 | 1 | 1 | 1 |
| 0 | 0 | 0 | 0 | 0 | 0 | 0 | 0 | 72 | 36 | 73 | 1 | 1 | 1 | 1 | 1 | 1 | 1 | 1 | 1 |
| 0 | 0 | 1 | 0 | 0 | 1 | 1 | 0 | 74 | 37 | 75 | 0 | 0 | 0 | 1 | 0 | 0 | 1 | 1 | 1 |
| 0 | 0 | 0 | 0 | 0 | 0 | 0 | 0 | 76 | 38 | 77 | 0 | 0 | 0 | 0 | 0 | 0 | 0 | 0 | 0 |
| 0 | 0 | 0 | 0 | 0 | 0 | 0 | 0 | 78 | 39 | 79 | 0 | 0 | 0 | 0 | 0 | 0 | 0 | 0 | 0 |
| 0 | 0 | 0 | 0 | 0 | 0 | 0 | 0 | 80 | 40 | 81 | 0 | 0 | 0 | 0 | 0 | 0 | 0 | 0 | 0 |
| 0 | 0 | 0 | 0 | 0 | 0 | 0 | 0 | 82 | 41 | 83 | 0 | 0 | 0 | 0 | 0 | 0 | 0 | 0 | 0 |
| 0 | 1 | 1 | 0 | 0 | 0 | 0 | 0 | 84 | 42 | 85 | 0 | 1 | 1 | 0 | 0 | 1 | 1 | 0 | 0 |
| 0 | 0 | 0 | 0 | 0 | 0 | 0 | 0 | 86 | 43 | 87 | 0 | 0 | 0 | 0 | 0 | 0 | 0 | 0 | 0 |
| 0 | 0 | 0 | 0 | 0 | 0 | 0 | 0 | 88 | 44 | 89 | 0 | 0 | 0 | 0 | 0 | 0 | 0 | 0 | 0 |
| 0 | 0 | 0 | 0 | 0 | 0 | 0 | 0 | 90 | 45 | 91 | 0 | 0 | 0 | 0 | 0 | 0 | 0 | 0 | 0 |
| 0 | 0 | 0 | 0 | 0 | 0 | 0 | 0 | 92 | 46 | 93 | 0 | 0 | 0 | 0 | 0 | 0 | 0 | 0 | 0 |
| 0 | 0 | 0 | 0 | 0 | 0 | 0 | 0 | 94 | 47 | 95 | 0 | 0 | 0 | 0 | 0 | 0 | 0 | 0 | 0 |
| 0 | 0 | 0 | 0 | 0 | 0 | 0 | 0 | 96 | 48 | 97 | 0 | 0 | 0 | 0 | 0 | 0 | 0 | 0 | 0 |
| 0 | 0 | 0 | 0 | 0 | 0 | 0 | 0 | 98 | 49 | 99 | 0 | 0 | 0 | 0 | 0 | 0 | 0 | 0 | 0 |
| 0 | 1 | 1 | 0 | 0 | 1 | 1 | 0 | 100 | 50 | 101 | 0 | 1 | 1 | 0 | 0 | 1 | 1 | 0 | 0 |
| 0 | 0 | 0 | 0 | 0 | 0 | 0 | 0 | 102 | 51 | 103 | 0 | 0 | 0 | 0 | 0 | 0 | 0 | 0 | 0 |
| 0 | 0 | 0 | 0 | 0 | 0 | 0 | 0 | 104 | 52 | 105 | 0 | 0 | 0 | 0 | 0 | 0 | 0 | 0 | 0 |
| 0 | 0 | 0 | 0 | 0 | 0 | 0 | 0 | 106 | 53 | 107 | 0 | 0 | 0 | 0 | 0 | 0 | 0 | 0 | 0 |
| 0 | 0 | 0 | 0 | 0 | 0 | 0 | 0 | 108 | 54 | 109 | 0 | 0 | 0 | 0 | 0 | 0 | 0 | 0 | 0 |
| 0 | 0 | 0 | 0 | 0 | 0 | 0 | 0 | 110 | 55 | 111 | 0 | 0 | 0 | 0 | 0 | 0 | 0 | 0 | 0 |
| 0 | 0 | 0 | 0 | 0 | 0 | 0 | 0 | 112 | 56 | 113 | 0 | 0 | 0 | 0 | 0 | 0 | 0 | 0 | 0 |
| 0 | 0 | 0 | 0 | 0 | 0 | 0 | 0 | 114 | 57 | 115 | 0 | 0 | 0 | 0 | 0 | 0 | 0 | 0 | 0 |
| 0 | 0 | 0 | 0 | 0 | 0 | 0 | 0 | 116 | 58 | 117 | 0 | 0 | 0 | 0 | 0 | 0 | 0 | 0 | 0 |
| 0 | 0 | 0 | 0 | 0 | 0 | 0 | 0 | 118 | 59 | 119 | 0 | 0 | 0 | 0 | 0 | 0 | 0 | 0 | 0 |
| 0 | 0 | 0 | 0 | 0 | 0 | 0 | 0 | 120 | 60 | 121 | 0 | 0 | 0 | 0 | 0 | 0 | 0 | 0 | 0 |
| 0 | 0 | 0 | 0 | 0 | 0 | 0 | 0 | 122 | 61 | 123 | 0 | 0 | 0 | 0 | 0 | 0 | 0 | 0 | 0 |
| 0 | 0 | 0 | 0 | 0 | 0 | 0 | 0 | 124 | 62 | 125 | 0 | 0 | 0 | 0 | 0 | 0 | 0 | 0 | 0 |
| 0 | 0 | 0 | 0 | 0 | 0 | 0 | 0 | 126 | 63 | 127 | 0 | 0 | 0 | 0 | 0 | 0 | 0 | 0 | 0 |

FIG. 17B

Am, Am-1
ℓ1
ℓ0
DIGIT SELECTION (1) OUTPUT
Da0, Da1, Da2, Da3
Da4, Da5, Da6, Da7
Db0, Db1, Db2, Db3
Db4, Db5, Db6, Db7
Db4, Db0, Da4, Da0
Db5, Db1, Da5, Da1
Db6, Db2, Da6, Da2
Db7, Db3, Da7, Da3
Db7, Db6, Db5, Db4
Db3, Db2, Db1, Db0
Da7, Da6, Da5, Da4
Da3, Da2, Da1, Da0
Da3, Da7, Db3, Db7
Da2, Da6, Db2, Db6
Da1, Da5, Db1, Db5
Da0, Da1, Db0, Db4
CHARACTER MEMORY
251
252
253
254
FORM MEMORY

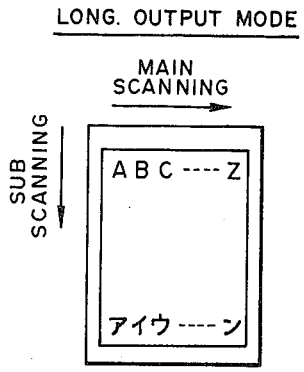

FIG. 25A

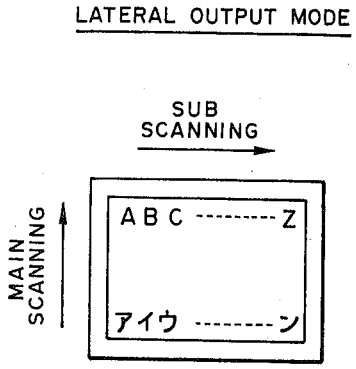

FIG. 25B

| H/V | Am, Am-1 | | a5 | a4 | a3 | a2 | a1 | a0 | |
|---|---|---|---|---|---|---|---|---|---|
| 0 (LONG. MODE) | 0 | 0 | L4 | L3 | L2 | C4 | C3 | C2 | LONG. MODE CHARACTER ACCESS; LONG. MODE FORM ACCESS |
| | 0 | 1 | $\overline{C4}$ | $\overline{C3}$ | $\overline{C2}$ | L4 | L3 | L2 | |
| | 1 | 0 | $\overline{L4}$ | $\overline{L3}$ | $\overline{L2}$ | $\overline{C4}$ | $\overline{C3}$ | $\overline{C2}$ | |
| | 1 | 1 | C4 | C3 | C2 | $\overline{L4}$ | $\overline{L3}$ | $\overline{L2}$ | |
| 1 (LATERAL MODE) | 0 | 0 | $\overline{C4}$ | $\overline{C3}$ | C2 | L4 | L3 | L2 | LATERAL MODE CHARACTER ACCESS; LATERAL MODE FORM ACCESS |
| | 0 | 1 | $\overline{L4}$ | $\overline{L3}$ | $\overline{L2}$ | $\overline{C4}$ | $\overline{C3}$ | $\overline{C2}$ | |
| | 1 | 0 | C4 | C3 | C2 | $\overline{L4}$ | $\overline{L3}$ | $\overline{L2}$ | |
| | 1 | 1 | L4 | L3 | L2 | C4 | C3 | C2 | |

FIG. 26

| H/V | Am, Am-1 | $\ell_1$ | $\ell_0$ | DIGIT SELECTION (1) OUTPUT | |
|---|---|---|---|---|---|
| 0 (LONG. MODE) | 0 0 | 0 | 0 | Da0, Da1, Da2, Da3 | LONG. MODE CHARACTER DATA |
| | | 0 | 1 | Da4, Da5, Da6, Da7 | |
| | | 1 | 0 | Db0, Db1, Db2, Db3 | |
| | | 1 | 1 | Db4, Db5, Db6, Db7 | |
| | 0 1 | 0 | 0 | Db4, Db0, Da4, Da0 | LONG. MODE FORM DATA |
| | | 0 | 1 | Db5, Db1, Da5, Da1 | |
| | | 1 | 0 | Db6, Db2, Da6, Da2 | |
| | | 1 | 1 | Db7, Db3, Da7, Da3 | |
| | 1 0 | 0 | 0 | Db7, Db6, Db5, Db4 | |
| | | 0 | 1 | Db3, Db2, Db1, Db0 | |
| | | 1 | 0 | Da7, Da6, Da5, Da4 | |
| | | 1 | 1 | Da3, Da2, Da1, Da0 | |
| | 1 1 | 0 | 0 | Da3, Da7, Db3, Db7 | |
| | | 0 | 1 | Da2, Da6, Db2, Db6 | |
| | | 1 | 0 | Da1, Da5, Db1, Db5 | |
| | | 1 | 1 | Da0, Da4, Db0, Db4 | |
| 1 (LATERAL MODE) | 0 0 | 0 | 0 | Db4, Db0, Da4, Da0 | LATERAL MODE CHARACTER DATA |
| | | 0 | 1 | Db5, Db1, Da5, Da1 | |
| | | 1 | 0 | Db6, Db2, Da6, Da2 | |
| | | 1 | 1 | Db7, Db3, Da7, Da3 | |
| | 0 1 | 0 | 0 | Db7, Db6, Db5, Db4 | LATERAL MODE FORM DATA |
| | | 0 | 1 | Db3, Db2, Db1, Db0 | |
| | | 1 | 0 | Da7, Da6, Da5, Da4 | |
| | | 1 | 1 | Da3, Da2, Da1, Da0 | |
| | 1 0 | 0 | 0 | Da3, Da7, Db3, Db7 | |
| | | 0 | 1 | Da2, Da6, Db2, Db6 | |
| | | 1 | 0 | Da1, Da5, Db1, Db5 | |
| | | 1 | 1 | Da0, Da4, Db0, Db4 | |
| | 1 1 | 0 | 0 | Da0, Da1, Da2, Da3 | |
| | | 0 | 1 | Da4, Da5, Da6, Da7 | |
| | | 1 | 0 | Db0, Db1, Db2, Db3 | |
| | | 1 | 1 | Db4, Db5, Db6, Db7 | |

FIG. 27

PATTERN GENERATING APPARATUS CAPABLE OF GENERATING PATTERNS BY CONTROLLING BASIC SYMBOLS

BACKGROUND OF THE INVENTION

1. Field of the Invention

The present invention relates to a pattern generating apparatus for use in a dot printer, cathode ray tube display, laser beam printer or the like, and more particularly to a pattern generating apparatus capable of providing various forms.

2. Description of the Prior Art

In apparatus for providing character information and form information, there is already known a method of making form lines by connecting form symbols of a same size as that of character symbols.

FIG. 1 shows an example of output of the characters with form lines, in which the form symbols are accessed in the same units as those for the characters A, B, C, . . . , X, Y, Z, a, b, c, . . . , x, y, z to provide continuous form lines.

The form lines in FIG. 1 require 9 form symbols (1) to (9) in FIG. 2, and further complicated form lines require additional 7 form symbols as shown in FIG. 3 (1) to (7).

In general, in order to express two kinds of lines, i.e. blank lines and solid lines in this case, there are required $2^4$ form symbols, as represented by the sum of the symbols shown in FIGS. 2 and 3.

In 3-kind representation including thin and thick solid lines, the number of required form symbols increases to $3^4=81$.

In further generalization, a representation involving form lines of N kinds requires $N^4$ form symbols. For example, a simple output representation involving thin and thick broken lines in addition to the foregoing, thus involving 5 kinds of form line, requires form symbols as many as $5^4=625$, form symbols and an addition of a chain line to this representation raises the number of required form symbols to 1250.

The number of data or character symbols has been made considerably clear due to recent investigations made toward the selection of minimum characters and symbols and the standardization of symbol style.

On the other hand, the number of form symbols, though it may seem relatively limited, becomes very large if increased freedom in form design is desired. In such apparatus the number of form symbols is proportional to the capacity of the form memory in the character generator and is an important factor in the cost and dimension of the entire apparatus.

SUMMARY OF THE INVENTION

The object of the present invention is to provide a pattern generating apparatus capable of generating, from a minimum number of basic form patterns, patterns rotated relative to basic form patterns.

Another object of the present invention is to provide a pattern generating apparatus capable of providing designs with increased freedom and variety from a limited number of symbols.

Still another object of the present invention is to provide a pattern generating apparatus capable of generating a required number of forms from a minimum necessary number of basic form symbols, thereby reducing the dimension, volume and cost of the apparatus.

These and still other objects of the present invention will become apparent from the following description to be taken in conjunction with the attached drawings.

BRIEF DESCRIPTION OF THE DRAWINGS

FIG. 5 is a chart showing an example of the cases where N=2–6 in FIG. 4;

FIG. 6 is a chart showing an example of the cases where a practically acceptable condition is added to the cases of FIG. 5;

FIGS. 25A and 25B are schematic views showing examples if longitudinal and lateral output modes;

FIG. 26 is a view similar to FIG. 23 corresponding to the case of FIG. 25; and FIG. 27 is a view similar to FIG. 24 corresponding to the case of FIG. 25.

DESCRIPTION OF THE PREFERRED EMBODIMENTS

Now a detailed explanation will be given of the present invention, while making reference to the attached drawings.

Figure 1:
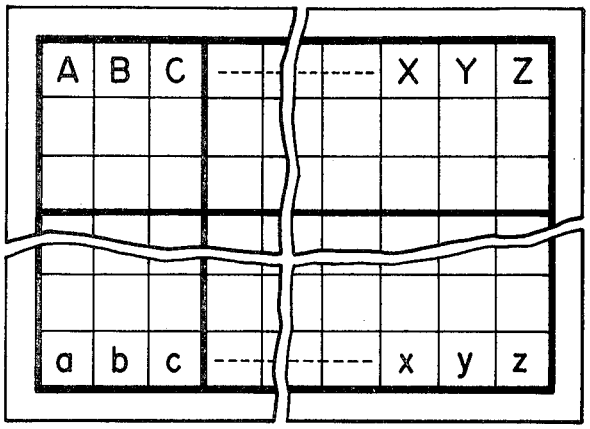
FIG. 1 is a schematic view showing an example of data output.
Figure 2:
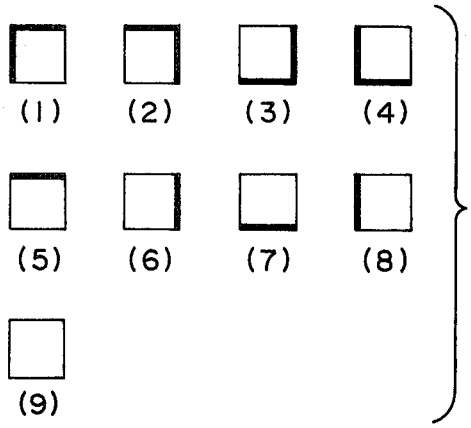
FIG. 2 is a schematic view of form symbols (1)–(9) required in the output shown in FIG. 1.

The patterns required in the data output in FIG. 1 are shown in FIG. 2, in which, according to the present invention, patterns (2), (3) and (4) are automatically generated from a form symbol (1), and patterns (6), (7) and (8) are similarly generated from a form symbol (5).

Figure 3:
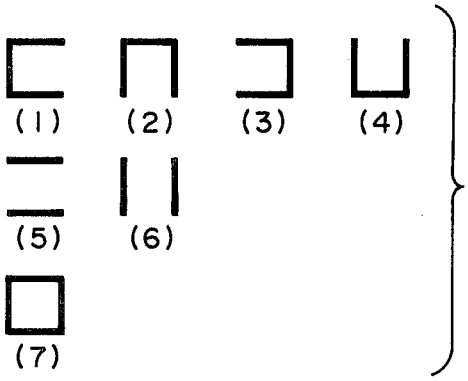
FIG. 3 is a schematic view of similar form symbols to those shown in FIG. 2 but not employed in FIG. 1.

Also in case of FIG. 3, patterns (2), (3) and (4) are automatically generated from a form symbol (1), and pattern (6) is similarly generated from a form symbol (5). In this manner 16 patterns shown in FIGS. 5 and 6 can be generated from the basic form symbols (1), (5) and (9) in FIG. 2 and (1), (5) and (7) in FIG. 3.

Figure 4:
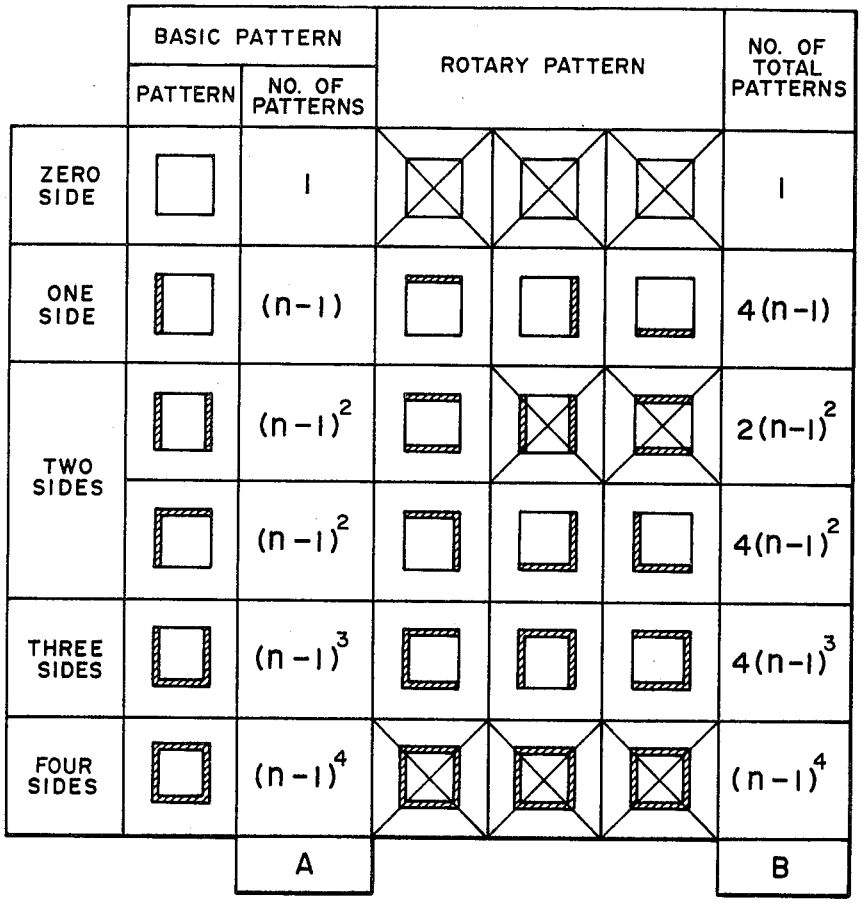
FIG. 4 is a chart showing the relationship between the numbers of required kind of representation N, a basic pattern or symbol and of total patterns or symbols.

FIG. 4 shows the relationship between the basic form symbols (basic patterns) and the total form symbols (total patterns) required.

The form symbols are classified into five categories from zero-sided to four-sided, among which the two-sided form symbol is further divided into two categories, so that there are six categories in total. Zero-sided form symbol means a bland box without image thereon. One-, two-, three-and four-sided form symbols respectively have patterns on a corresponding number of sides thereof.

Rotational patterns are obtained by rotating the basic patterns. The rotational patterns identical with the basic pattern or other rotational pattern are indicated with crosses.

"n" indicates the kind of forms such as thin solid line, thick solid line, thin broken line, thick broken line etc. Including the "blank" within "n", the number of these basic patterns can be represented, as a function of "n", as $(n-1)^0$, $(n-1)^1$, $(n-1)^2$,$(n-1)^2$, $(n-1)^3$ and $(n-1)^4$, of which sum A represents the total number of such basic patterns. Also the total number of zero- to four-sided patterns, including the rotational patterns obtained by rotating the basic patterns, is respectively represented by $(n-1)^0$, $4(n-1)^1$, $2(n-1)^2$, $4(n-1)$hu 2, $4(n-1)^3$ and $(n-1)^4$, of which sum B is equal to $n^4$ as explained in the foregoing.

FIG. 5 shows the number of basic patterns $A_2$, the number of total patterns $B_2$ and their ratio $B_2/A_2$ for values of n from 2 to 6.

In order to generate all the patterns from the basic patterns stored in the apparatus a larger value of the ratio $B_2/A_2$ is naturally more efficient. However, as shown in FIG. 5, the ratio is as high as 2.67 for n=2, but is decreased to 1.61 for n=6. This is still more efficient than having all the patterns $B_2$ in the apparatus, but the ratio tends to converge to unity if the value of n is increased for freer and more varied designs.

In practice, however, the frequency of appearance of form symbols in the designing and output of data forms decreases in the order of zero-, one-, . . . , four-sided symbols. Particularly the four-sided form symbol should be considered rather as a special symbol, and is never used as the the basic form symbol. Thus, only accepting the four-sided form symbols having the same kind of patterns on four sides, the number of four-sided basic patterns or total patterns shown in FIG. 4 is reduced to (n−1).

FIG. 6 shows, on this assumption of (n−1) four-sided symbols, the number of basic patterns $A_1$, the number of total patterns $B_1$ and the ratio $B_1/A_1$ for the values of n from 2 to 6.

Figure 7:
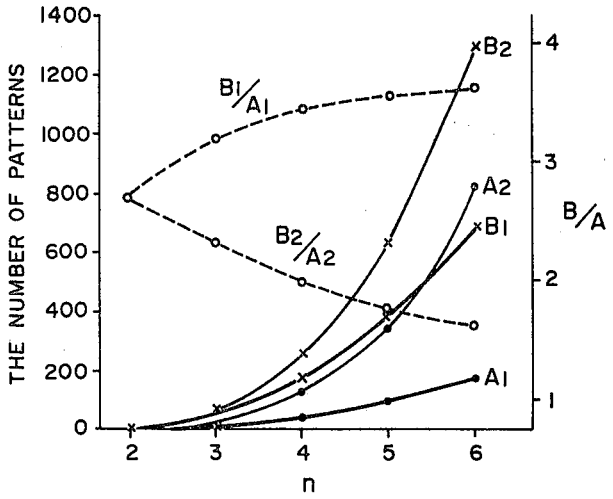
FIG. 7 is a chart graphically showing the relations shown in FIGS. 5 and 6.

In this case the value of said ratio is 2.67 for n=2, which is the same as shown in FIG. 5, but the value of said ratio converges to 4 for a larger value of n. The calculations in FIGS. 5 and 6 are graphically compared in FIG. 7. In this manner, by generating all the patterns from the basic patterns, it is rendered possible to achieve free and variable form designing with a limited form symbol memory.

Figure 8:
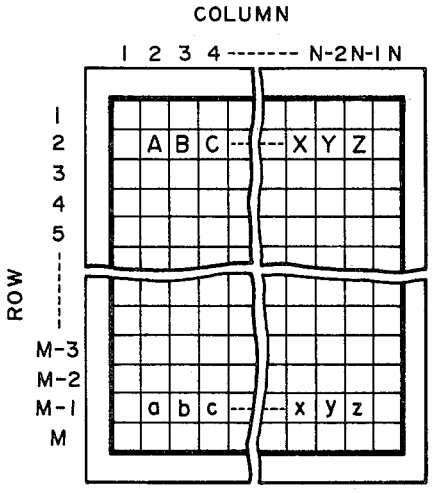
FIG. 8 is a schematic view showing an example of data output without overlapping.
Figure 9:
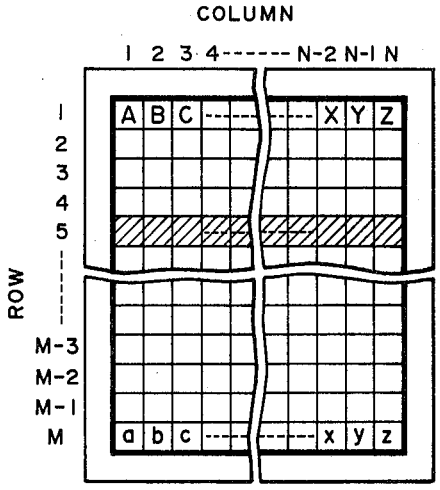
FIG. 9 is a schematic view showing an example of data output with overlapping.

The data output may be conducted in such a manner that a character area does not contain simultaneous output of character symbol and form symbol (without overlapping function) as shown in FIG. 8, or in such a manner that a character area contains simultaneous output of a character symbol and a form symbol (with overlapping function) as shown in FIG. 9. The present invention is not related to the presence or absence of such overlapping function but is related to the generation of plural patterns from a basic pattern, but in the following description there will be explained a case of data output with such overlapping function.

Figure 10:
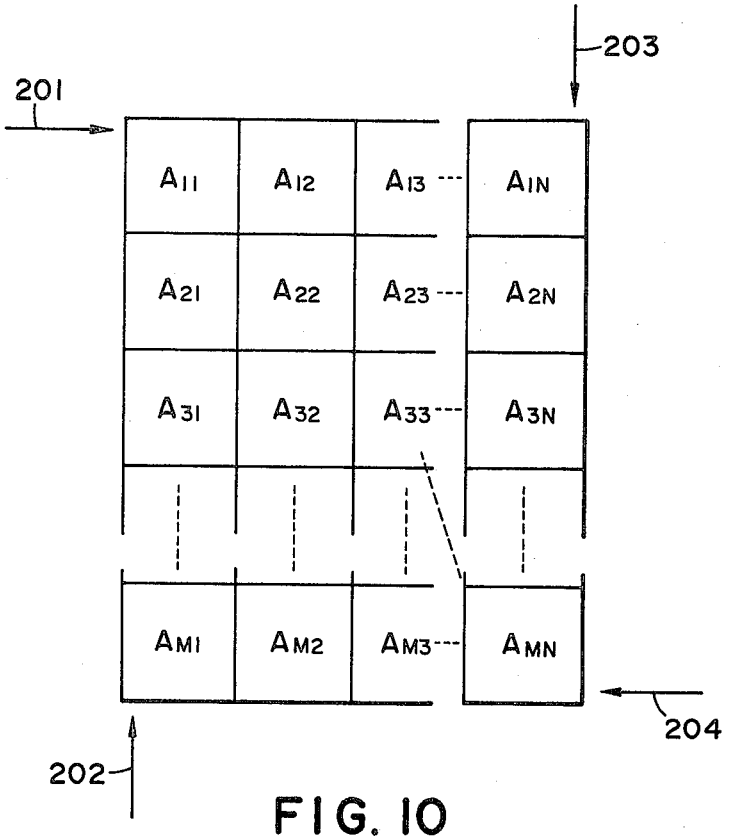
FIG. 10 is a view showing character boxes for the characters and forms.
Figure 11:
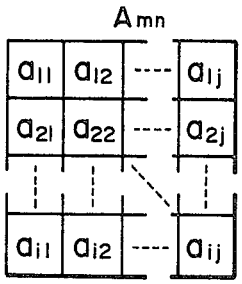
FIG. 11 is a view of unit matrix in said character box.

FIG. 10 shows a dividing method of a dot pattern in the present embodiment, wherein a dot pattern of a character or a form is divided into a group $A_{MN}$ of unit matrixes of M rows and N columns, wherein each unit matrix $A_{mn}$ is divided into elements $a_{ij}$ corresponding to the elementary dots as shown in FIG. 11.

Said elements $a_{ij}$ of the unit matrix group $A_{MN}$ are arranged in succession as shown in FIG. 11 and stored in a memory wherein a word is composed of (i·j) bits. For example in case of i=j=4, such data storage can be made in a memory with 16-bit words, or in simultaneously accessible two memories with 8-bit words. Such memories can naturally be replaced by four memories with 4-bit words or sixteen memories with 1-bit words, and, in any case, (i·j) bits should be simultaneously accessible. Thus all dots of a dot pattern can be stored in (M·N) words of such memory.

Figure 12:
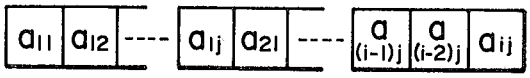
FIG. 12 is a schematic view showing an example of output data in said unit matrix.

In the pattern generation from the memory having such divided dot pattern, said memory can be accessed in the order of $A_{11}$, $A_{12}$, $A_{13}$, . . . , $A_{MN}$ and the obtained data $a_{ij}$ can be utilized as video signals in the pattern generator in the order of $a_{11}$, $a_{12}$, $a_{13}$, . . . as shown in FIG. 12 to obtain an ordinary pattern.

Also a pattern rotated clockwise by 90° can be obtained by accessing said memory in the order of $A_{M1}$, $A_{(M-1)1}$, . . . , $A_{11}$, $A_{M2}$, $A_{(M-1)2}$, . . . , $A_{MN}$, . . . , $A_{1N}$ and utilizing the obtained data as video signals in the pattern generator in the order of $a_{i1}$, $a_{(i-1)1}$, . . . , $a_{21}$, $a_{11}$.

Similarly a pattern rotated by 180° can be obtained by accessing said memory in the order of $A_{MN}$, $A_{M(N-1)}$, . . . , $A_{M2}$, $A_{M1}$, . . . , $A_{(M-1)2}$, $A_{(M-1)1}$, . . . , $A_{1N}$, $A_{1(N-1)}$, . . . , $A_{11}$ and utilizing the obtained data $a_{ij}$ as the video signals in the order of $a_{ij}$, $a_{i(j-1)}$, . . . , $a_{i2}$, $a_{i1}$.

In this manner the rotation of the pattern can be easily achieved by changing the order of access to the unit matrix group $A_{MN}$ and the order of readout of data $a_{ij}$.

A condition i=j is preferable in order to facilitate such pattern rotation and to simplify the related circuitry. For this reason the unit matrix group $A_{MN}$ preferably has elements constituting a square matrix.

In further consideration of the recent development of computer-related devices, an additional condition $i=j=2l$ (l=1, 2, . . . ) should preferably be satisfied. Also a high-speed pattern generation can be easily achieved by selecting large values for i and j.

There are no limiting factors for M and N defining the size of the matrix group, but the related circuits can naturally be simplified if a condition $M, N=2^L$ (L=1, 2, 3, . . . ) is met.

Figure 13:
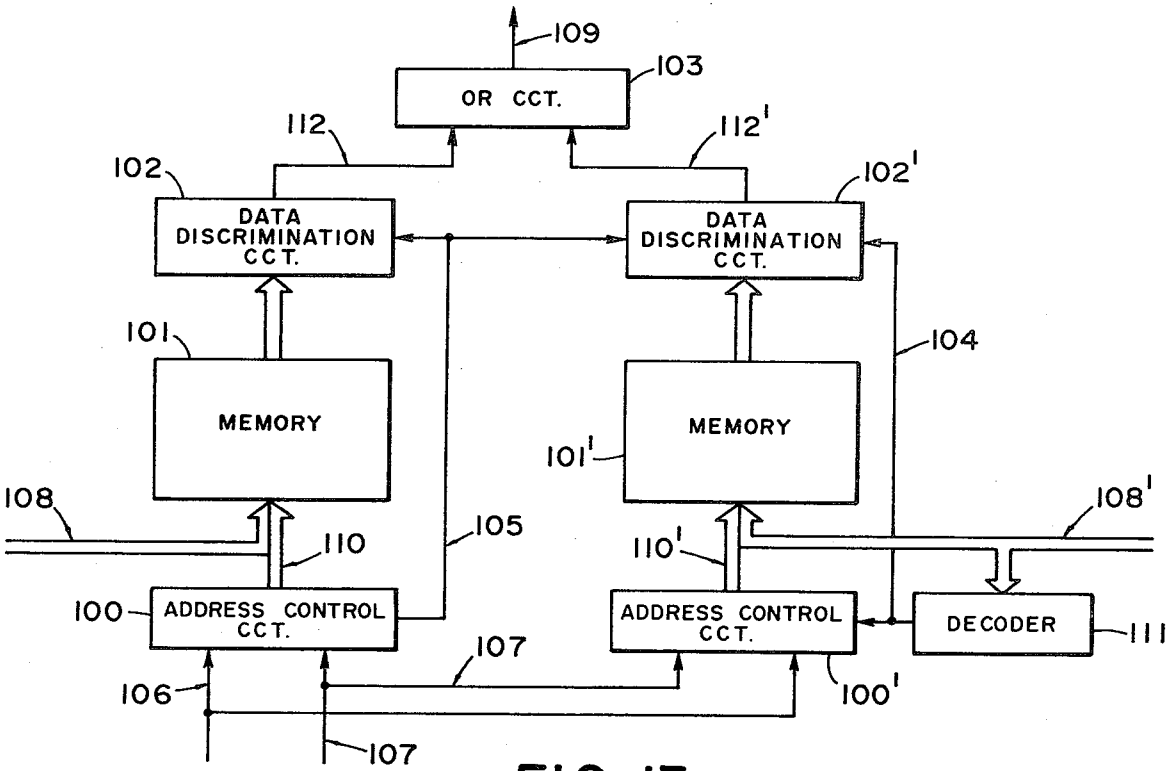
FIG. 13 is a block diagram showing the outline of the present invention.

FIG. 13 shows, in a block diagram, the pattern generating apparatus having a memory structure of the present invention, wherein there are shown address control circuits 100, 100', a character generating memory 101, a form generating memory 101', and data discriminating circuits 102, 102' selectively supplying output data from the memories as video signals to an unrepresented pattern generator.

While the address control circuit 100 for characters functions according to a determined sequence, the address control circuit 100' for forms determines the address sequence of the memory so as to obtain the data output in the aforementioned manner in response to a signal 104 from a decoder 111 for determining the image rotation angle of the output pattern. The necessary address is determined in response to an X-synchronizing signal 106 and a Y-synchronizing signal 107 from the unrepresented pattern generator, and the contents of the memories 101, 101' corresponding to said address are supplied to the data discriminating circuits 102, 102'.

Simultaneously the address control circuit 100 supplies clock signals 105, in response to which the data discriminating circuits select the necessary signal from the data supplied from the memories 101, 101' and generate character output signals 112, 112' to the pattern generator. The aforementioned address control circuits 100, 100' determine the access, respectively for characters and forms, in a character box. The addresses for characters and forms for the character generator are supplied through address lines 108 and 108', of which the former is utilized in combination with a box address line 110 from the address control circuit 100. In this manner the signals for characters and those for forms are respectively generated through the channels of 101 - 102 - 112 and 101' - 102' - 112', and said character signals 112 and form signals 112' are supplied to a line 109 through an OR circuit 103.

Now, the present embodiment will be further explained in detail by an example where $i=4$, $j=4$, $M=8$ and $N=8$ with two kinds of unit matrix memories. In the following description the functions for characters and for forms are not distinguished since the basic function is the same for both cases.

Figure 14:
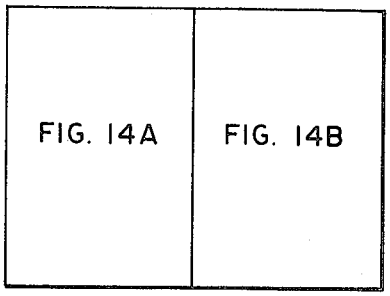
FIGS. 14A and 14B together are a chart showing an example of the character boxes shown in FIG. 10.
Figure 15:
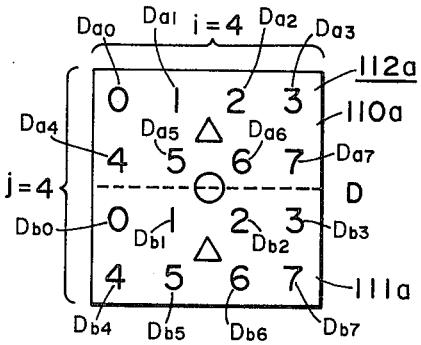
FIG. 15 is a chart showing an example of the unit matrix shown in FIG. 11.

FIG. 15 shows a unit matrix memory corresponding to that shown in FIG. 11, and FIG. 14 shows an example of the memory matrix group corresponding to that shown in FIG. 10 and under the above-mentioned conditions.

Figure 16:
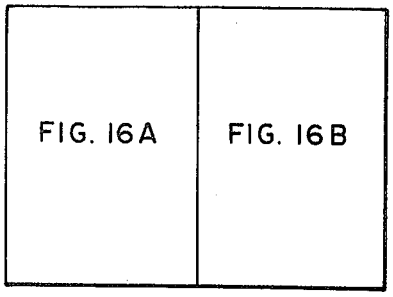
FIGS. 16A and 16B together are combination a chart showing an example of the character "P" in the character boxes shown in FIGS. 14A and 14B.

As shown in FIG. 15, each unit matrix 112*a* in the matrix group is composed of two different memories a (110*a*) and B (111*a*). The numeral in the triangle indicates the memory address at the data write-in, and the numeral in the circle indicates the memory address at the data read-out. FIG. 16 shows the memory state for example in case of a character "P" in said memory matrix group.

Figure 17:
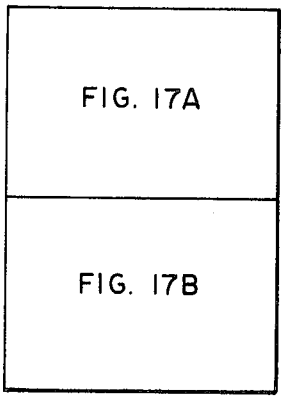
FIGS. 17A and 17B together show a developed view of the memory employed in FIGS. 16A and 16B.

As shown in FIG. 17, the memories A, B are composed of read-only memories or random access memories of 8-bit word structure, each of which corresponds to plural characters $a_1$–$a_n$ or $b_1$–$b_n$, and the details of each character unit in said memories $a_1$–$a_n$ and $b_1$–$b_n$ are shown as $a_x$ and $b_x$. AD indicates the addresses of the memory matrix at the character generator operation.

The illustrated memories $a_x$ and $b_x$ correspond the dot pattern shown in FIG. 16 and show how the data for character "P" are stored.

The structure of said memories A and B can be suitably selected according to the dimension of said unit matrix i, j in consideration of the various hardware conditions such as the character generating speed, memory speed, parallel data writing capacity of the CPU into the random access memory etc. In the present embodiment said memories are selected as 8-bit word structure since the CPU is assumed to have a parallel data processing capacity of 8 bits.

However it is naturally possible also to constitute each of said memories A and B with 8 units of 1-bit word structure, or 4 units of 2-bit word structure, or 2 units of 4-bit word structure.

Now there will be explained the relationship between the scanning operation and the aforementioned memories.

Figure 18:
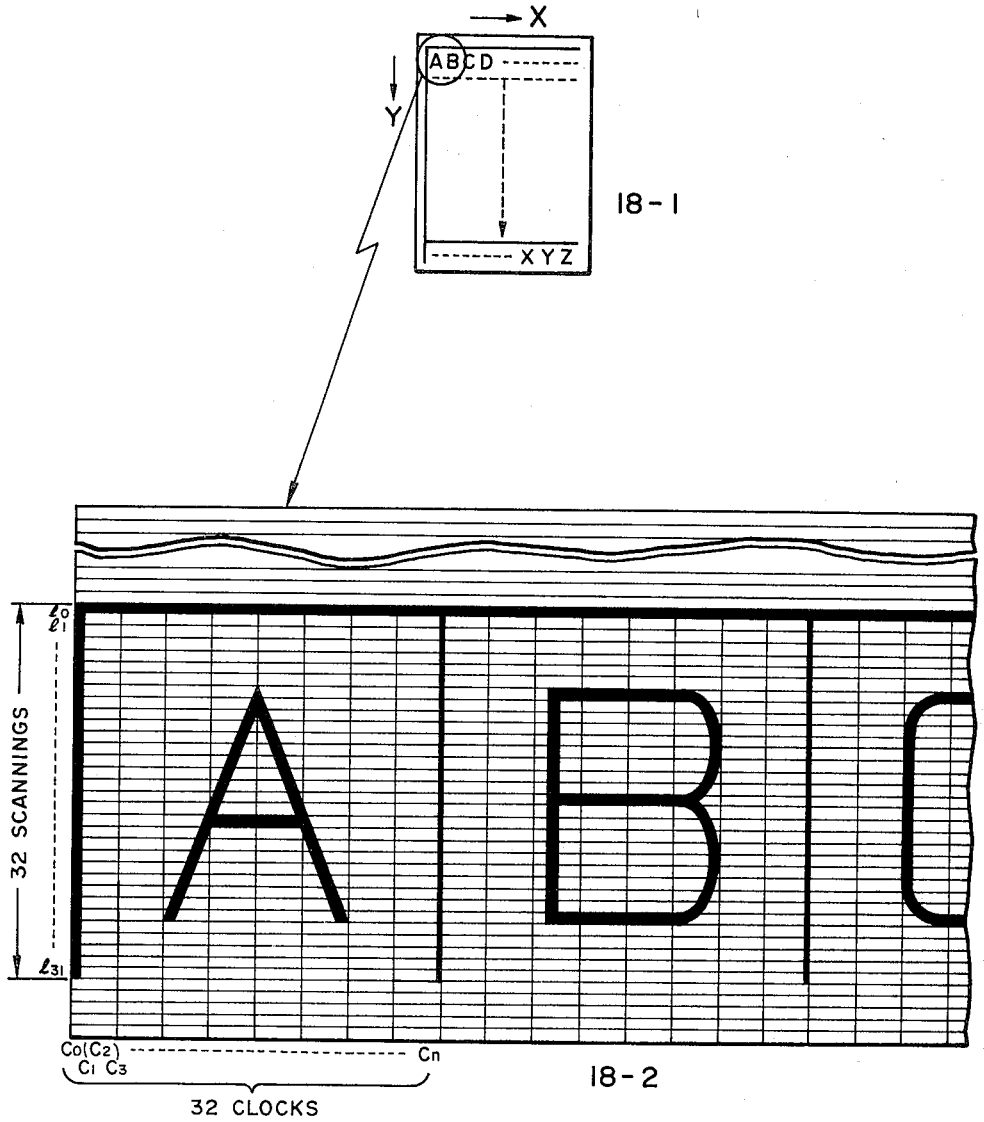
FIG. 18 is a magnified view of an example of data output.
Figure 19:
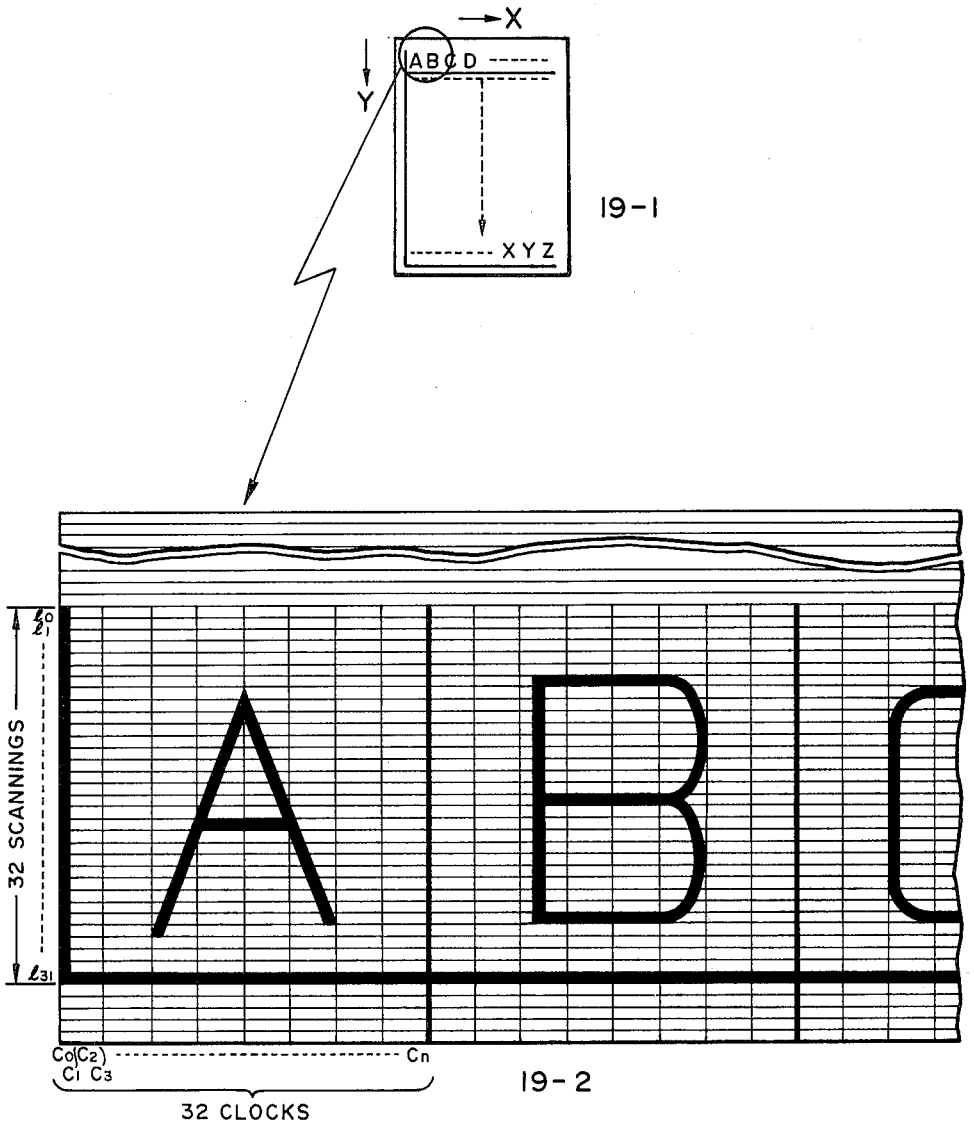
FIG. 19 is another magnified view of an example of data output.
Figure 20A:
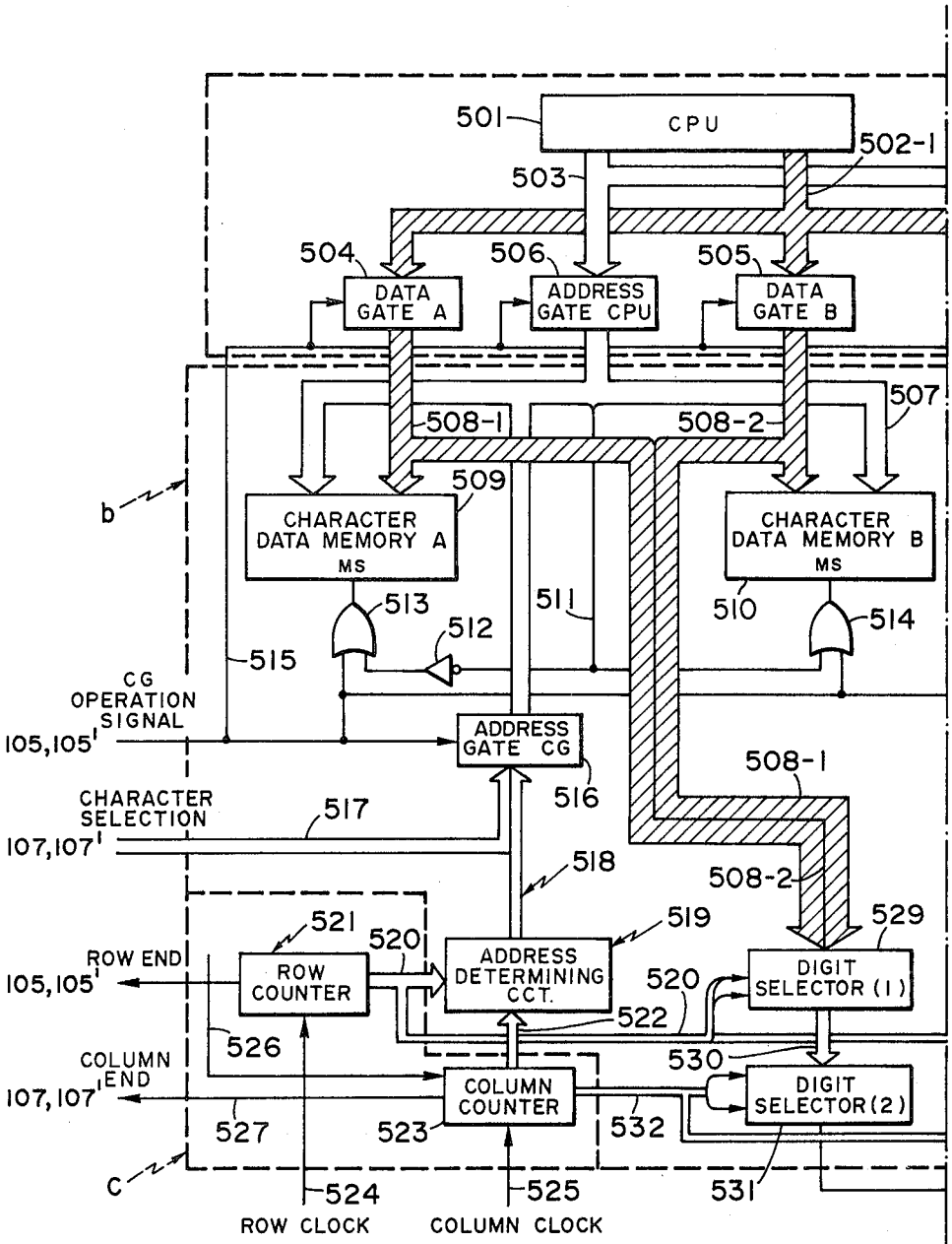
Figure 20B:
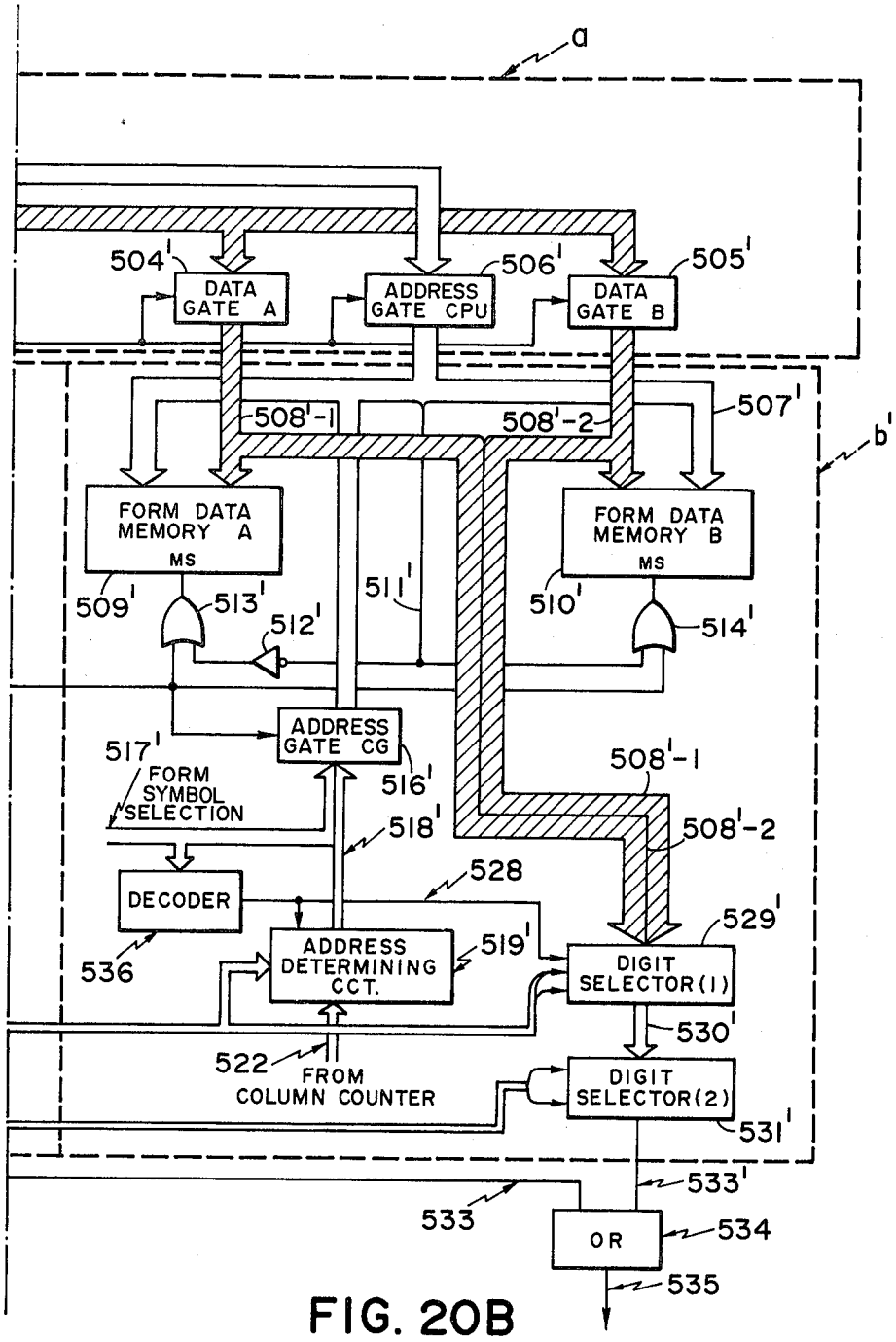

FIGS. 18 and 19 show examples of output of characters and forms, wherein the arrows X and Y in FIGS. 18-1 or 19-1 respectively indicate the principal and auxiliary scanning directions at the data output.

The outputs in FIGS. 18-1 and 19-1 have the same character data but different form data, as shown in FIGS. 18-2 and 19-2 in magnified scale.

In these FIGS. $l_0, l_1, l_2, l_3, \ldots$ indicate the scanning lines in the Y-direction, while $C_0, C_1, C_2, C_3, \ldots$ indicate the clock pulse number in the X-direction, respectively corresponding to those symbols shown in FIG. 16.

Thus, in the present embodiment, for a single character or form, the unit memory matrixes are accessed in the order of 0, 1, 2, 3, 4, . . . , 63 by the numbers shown in the circles in FIG. 14. Also the data selection is made in the order of $Da_0, Da_1, Da_2, Da_3, \ldots, Da_4, Da_5, Da_6, Da_7, \ldots, Db_0, Db_1, Db_2, Db_3, \ldots, Db_4, Db_5, Db_6$ and $Db_7$, wherein $Da_0$ to $Da_7$ and $Db_0$ to $Db_7$ respectively indicate the data in the memory cell A 110*a* and memory cell B 111*a*.

Figure 20:
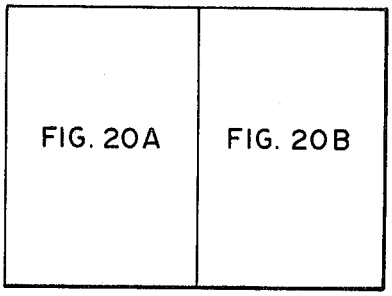
FIGS. 20A and 20B together are a block diagram of an embodiment of the present invention.
Figure 14A:
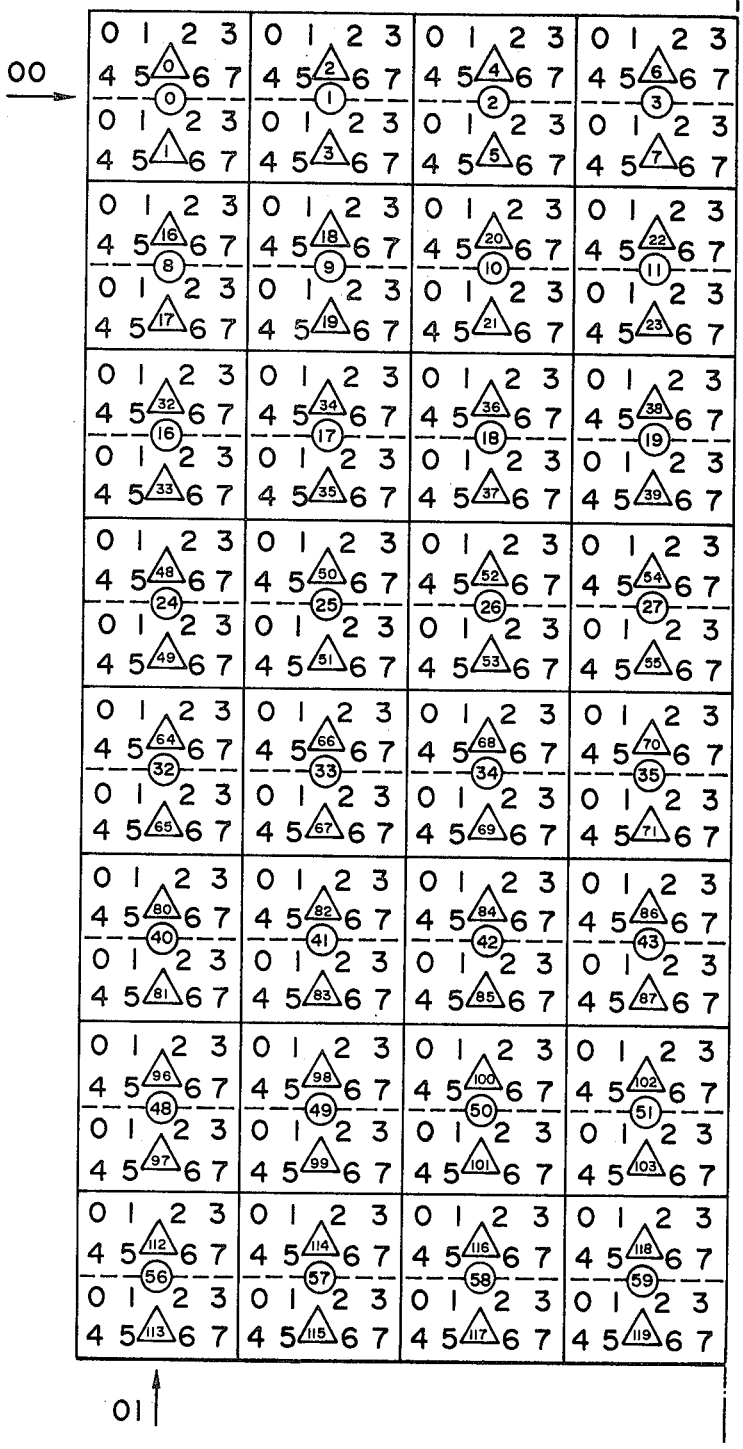
Figure 14B:
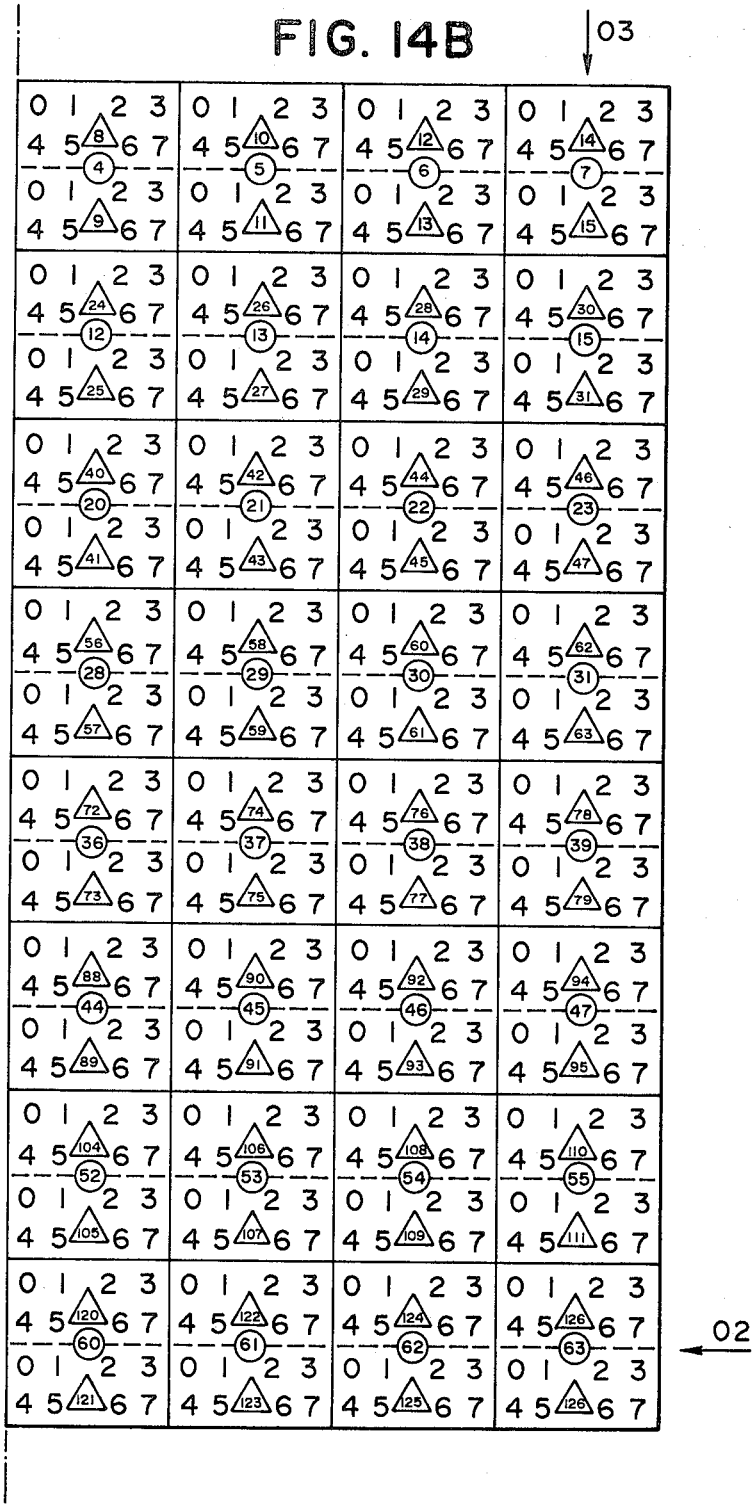
Figure 17A:
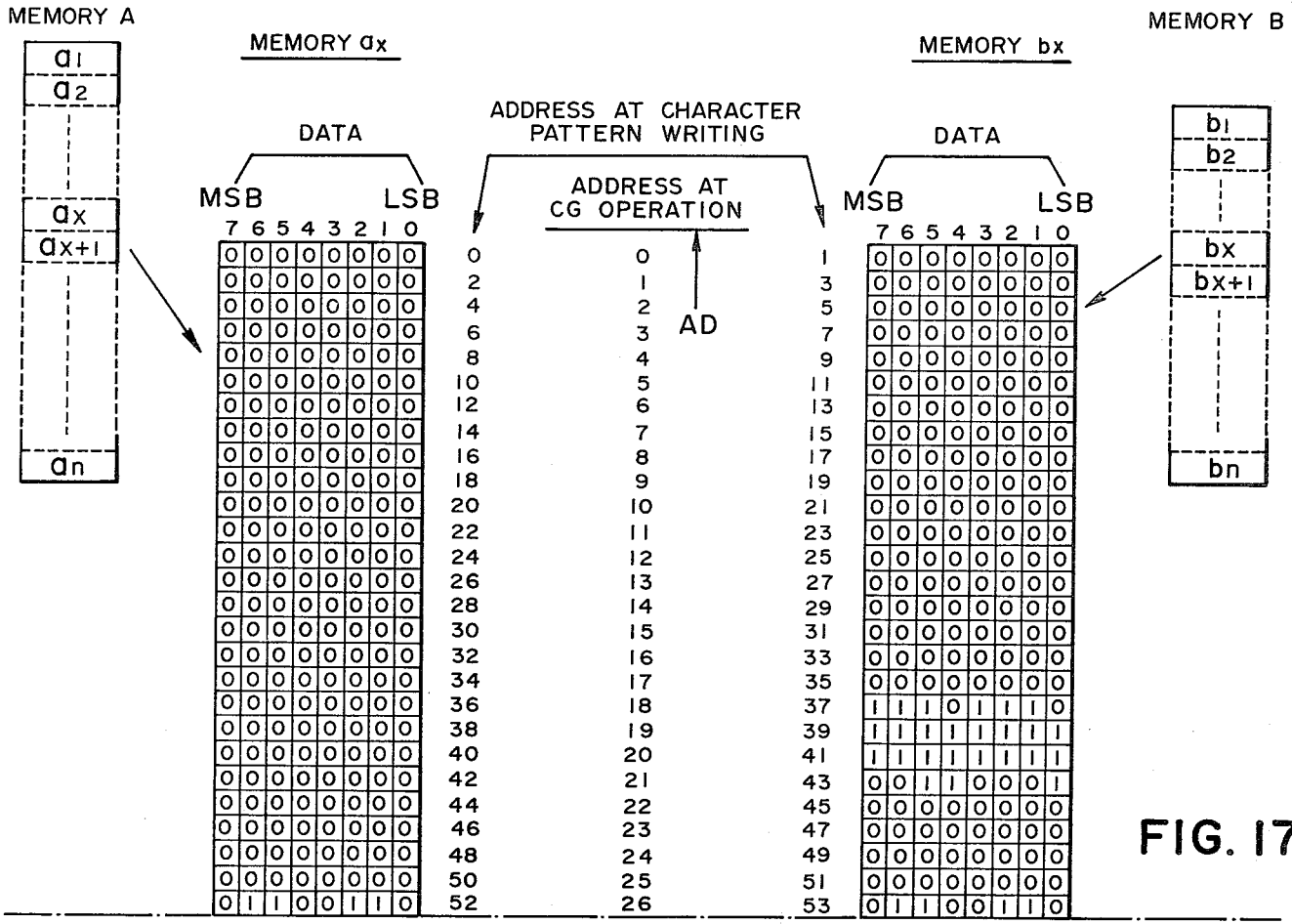

Now reference is made to FIG. 20 showing the control block diagram of the present embodiment, employing a random access memory as the character memory for enabling character data write-in by the CPU.

The block diagram is composed of a central processing unit a for writing the character data into a character memory and the form data into a form memory, a character pattern generator unit b, a form pattern generator unit b' and a synchronizing signal generating unit c for ensuring synchronized function of the printer.

A central processing unit 501 for storing character and form data reads the character data and form data from other unrepresented mass memory means such as memory tape or magnetic disc and stores said data in character data memories A509, B510 and form data memories A509', B510'. The character data and form data are supplied to the character data memories A 509, B510 and the form data memories A 509', B 510' through a data line 502-1, data gates A 504, 504', data gates B 505, 505', and output lines thereof 508-1, 508'-1, 508-2, 508'-2.

The address signals from the CPU 501 are supplied to the respective memories A, B through an address line 503, address gates 506, 506' and lines 507, 507'. Address lines 511, 511' are utilized for selecting the memory A or B by a particular bit signal.

In the embodiment shown in FIG. 20 employed for this purpose is the lowermost digit bit, which selects the memory A or B respectively at "0" or "1". Inverters 512, 512' are provided to invert the signals through the lines 511, 511'.

OR circuits 513, 514, 513' and 514' are provided to select the memories according to the signals supplied through the signal lines 511, 511', and to simultaneously access the memories A and B in the function as the character or form generator.

A signal line 515 transmits a character generator operation signal, which is supplied to the character and form data gates 504, 505, 504', 505' and to the character and form address gates 506, 506' to inhibit the connection of data and address with the CPU.

Also said signal is supplied to the address gates 516, 516' to connect character and form selecting signal lines 517, 517' and intramatrix selecting signal lines 518, 518' with the character and form data memories A and B.

Memory address determining circuits 519, 519' causes the access to the unit memory matrix in the aforementioned order. A counter 521 supplies the row count signal, $l_0, l_1, l_2, l_3, \ldots, l_{31}$ in FIGS. 18 and 19, through a line 520, and is composed of a 5-bit counter to repeat the count from 0 to 31. Also a counter 523 supplies the column count signals $C_0, C_1, C_2, \ldots, C_{31}$ in FIGS. 18 and 19, through a line 522 and is likewise composed of a 5-bit counter for repeating the counting operation from 0 to 31 .

The counting functions of said row counter 521 and column counter 523 are respectively controlled by the row clock signals functioning as the synchronizing signal for the scanning lines in the X-direction and the column clock signals synchronized with the pixel frequency, received through signal lines 524, 525.

The row and column counters 521, 523 respectively provide row and column end signals to an unrepresented external control circuit at the end of every 32 counting operations.

Said external control circuit, detecting the switching of character and form addresses at each column end signal, supplies in synchronization therewith the addresses of characters and forms for output in succession through lines 517, 517'. Also said circuit, detecting the completion of characters or forms of a line at each row end signal, supplies in synchronization therewith the addresses of the characters and forms for output in the succeeding line.

A character address determining circuit 519 in the present embodiment functions according to a determined sequence during the character generating operation as will be further explained in the following, but a form address determining circuit 519' is controlled by a rotation instruction signal supplied through a signal line 528 and assumes different sequences in obtaining rotated patterns from the basic form symbol of the present invention, as will also be explained in the following. In the character generating function, the character and form data memories A, B composed of memories 509, 510, 509', 510' provide data output through lines 508-1, 508-2 and 508'-1, 508'-2, each of 8 bits set of 16 bits for forms, to digit selectors (1) 529, 529', then to digit selectors (2) 531, 531' through signal lines 530, 530'.

The character digit selector (1) or the form digit selector (1) in case without rotation of the basic pattern (the case with rotation to be explained later) successively selects each of 4-bit groups ($Da_0, Da_1, Da_2, Da_3$), ($Da_4, Da_5, Da_6, Da_7$), ($Db_0, Db_1, Db_2, Db_3$) and ($Db_4, Db_5, Db_6, Db_7$) shown in FIG. 15.

Then the digit selector (2) releases in succession, in response to the column count signals, the 4bit signals selected by the digit selector (1). The time-sequential character and form video signals thus released to signal lines 533, 533' in synchronization with the column clock signals are mixed in an OR circuit 534 and supplied as a mixed character and form video signal to a signal line 535 for display on a cathode ray tube, for modulation of a laser beam, for facsimile output etc.

The present invention has been outlined in the foregoing, but there will be given further explanation on the details of the address determining circuits 519, 519' and of the digit selectors 529, 529', 531 and 531'.

At first there will be explained the access operations to the character memory and form memory in the character generating operation.

Figure 21:
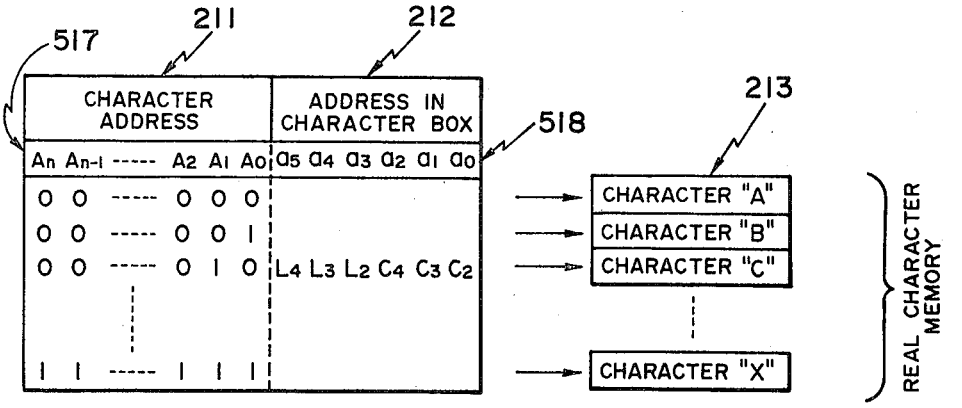
FIG. 21 is an explanatory view of address signals for character pattern access.
Figure 22:
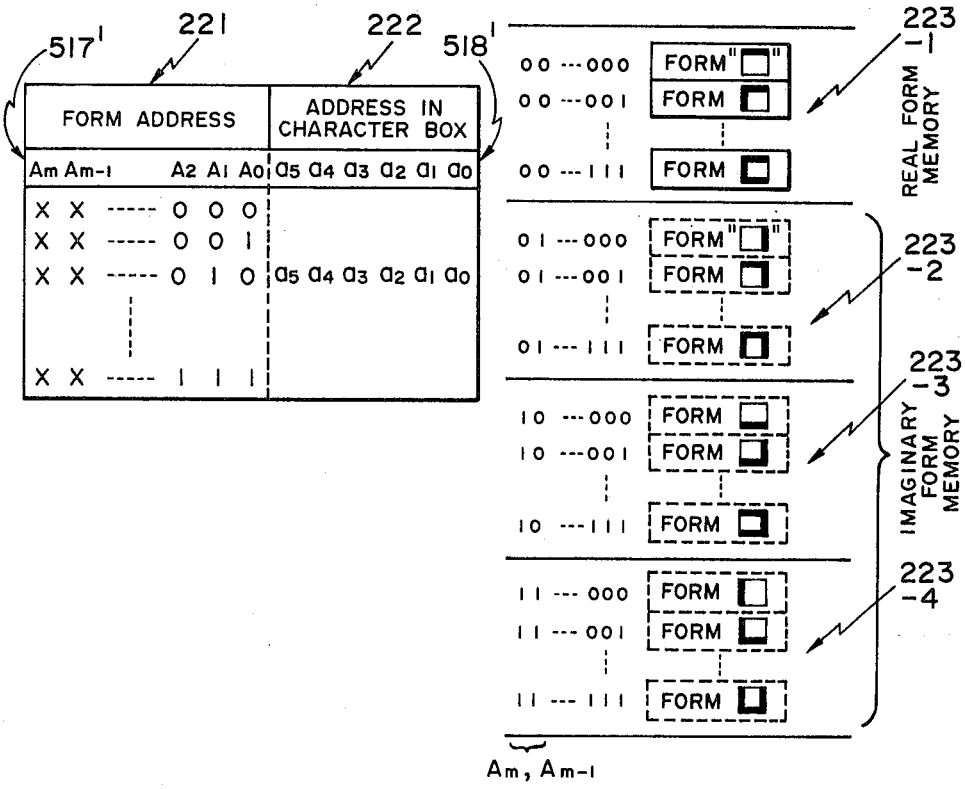
FIG. 22 is an explanatory view of address signals for form pattern access.

In FIGS. 21 and 22, there are shown character and form symbol selecting signals 211, 221 supplied to lines 517, 517' in FIG. 20. Said signals correspond to 108, 108' in FIG. 13 and to the address signals for access to unit character boxes ($a_1, b_1$), ($a_2, b_2$), . . . , ($a_x, b_x$) shown in FIG. 17. Also there are shown signals 212, 222 to be supplied to lines 518, 518' in FIG. 20 for access in the character box. Said signals correspond to 110, 110' in FIG. 13 and to the addresses 0–63 in FIG. 17 at the character generating operation.

The addresses 211, 221 for characters and forms, shown in FIGS. 21 and 22, are supplied to address gates 516, 516' in FIG. 20 for selecting characters A, B, C, . . . , X as shown by 213 in FIG. 21 and selecting various form symbols as shown by 223-1 to 223-4 in FIG. 22.

Figure 23:
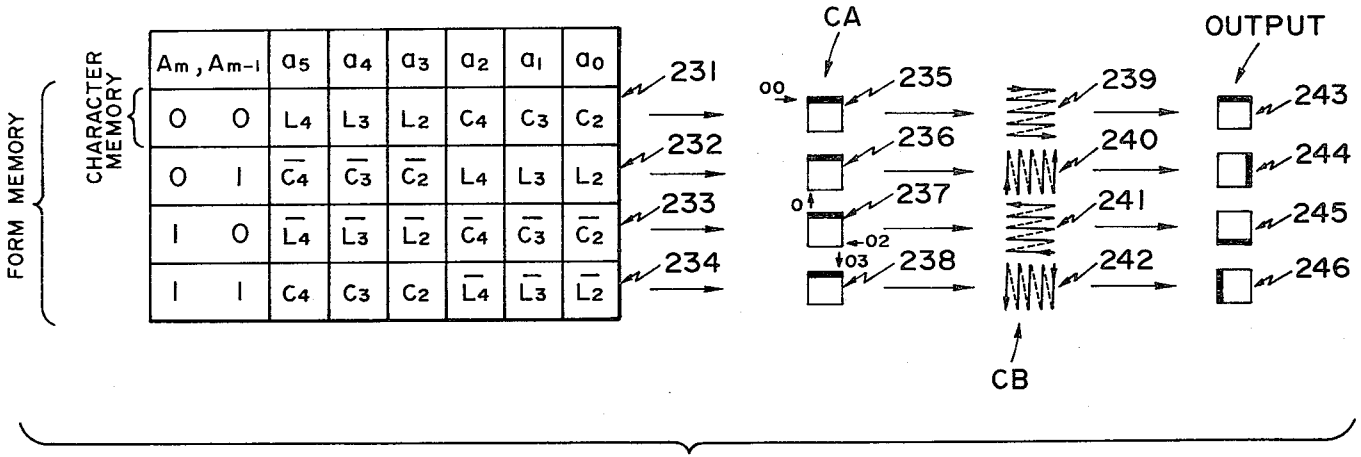
FIG. 23 is an explanatory view of address signals for access in a character box for character and form pattern access.

The addresses 212, 222 in the character box are given by 6 bits $a_5$–$a_\phi$, as shown in detail in FIG. 23. As shown therein, the character address determining circuit 519 receives the signals $L_4$ - $L_2$ and $C_4$ - $C_2$ among the output signals $L_4$ - $L_0$ and $C_4$ - $C_0$ the row counter 521 and the column counter 523, and releases the signals $L_4$, $L_3$, $L_2$, $C_4$, $C_3$ and $C_2$ constantly as the address signals $a_5$–$a_\phi$ in the character box to the line 518. In this manner the address of the unit matrix is designated by the upper three bits of the output signals of said row counter 521 and column counter 523, and the position in the unit matrix is designated by the lower two bits of said signals.

Consequently in a diagram 235 shown in FIG. 23 representing FIGS. 14 and 16 in combination, the access to the unit matrixes is always conducted in an order represented by 239. Thus, if the diagram 235 corresponds to a character "A", there will always be obtained an output "A".

On the other hand the form address determining circuit 519' either selects $a_5$–$a_\phi$ as shown by 231 in FIG. 23 in the same manner as the character address determining circuit 519 to select the unit matrixes in the order of 239 thereby obtaining the basic pattern as represented by 243, or makes access as shown by 232–234 to select the unit matrixes in the order of 240–242, whereby the same pattern 236–238 is respectively scanned from the arrow position to obtain the patterns rotated respectively by 90° , 180° and 270° from the basic pattern.

The signals $a_5$ to $a_\phi$ for characters are fixed as $L_4$, $L_3$, $L_2$, $C_4$, $C_3$ and $C_2$ as mentioned above, but the signals for forms select the states 231–234 according to the upper two bits Am and $Am^{-1}$ of the form pattern address, as shown at the left-hand end of FIG. 23. More specifically "00", "01", "10" and "11" respectively indicate the access orders of unit matrixes as shown by 239, 240, 241 and 242.

The output of different images such as 243–246 by the control of the upper two bits of the form address means as if the selection is made from a group of form patterns 223-2, 223-3 and 223-4 in addition to the pattern 223-1 actually provided in the form generator.

Stated otherwise, the signal formation of $a_5$–$a_\phi$ as shown in FIG. 23 corresponds to the expansion of the actual form pattern group 223-1 into the imaginary form pattern group 223-2, 223-3, 223-4.

In the foregoing explanation is given of the access means of the present invention capable of generating four times expanded different patterns from the actually existing patterns by changing the order of access to the unit matrixes in the character box.

Now there will be explained how the data thus obtained are supplied as output in relation to said access.

The aforementioned access to the unit matrix provides 16-bit data as shown in FIG. 15.

The access in the character box is conducted with the order of 239, 240, 241 or 242 shown in FIG. 23 according to whether the upper two bits Am and $Am^{-1}$ are respectively "00", "01", "10" or "11".

Figures 24A, 24B:
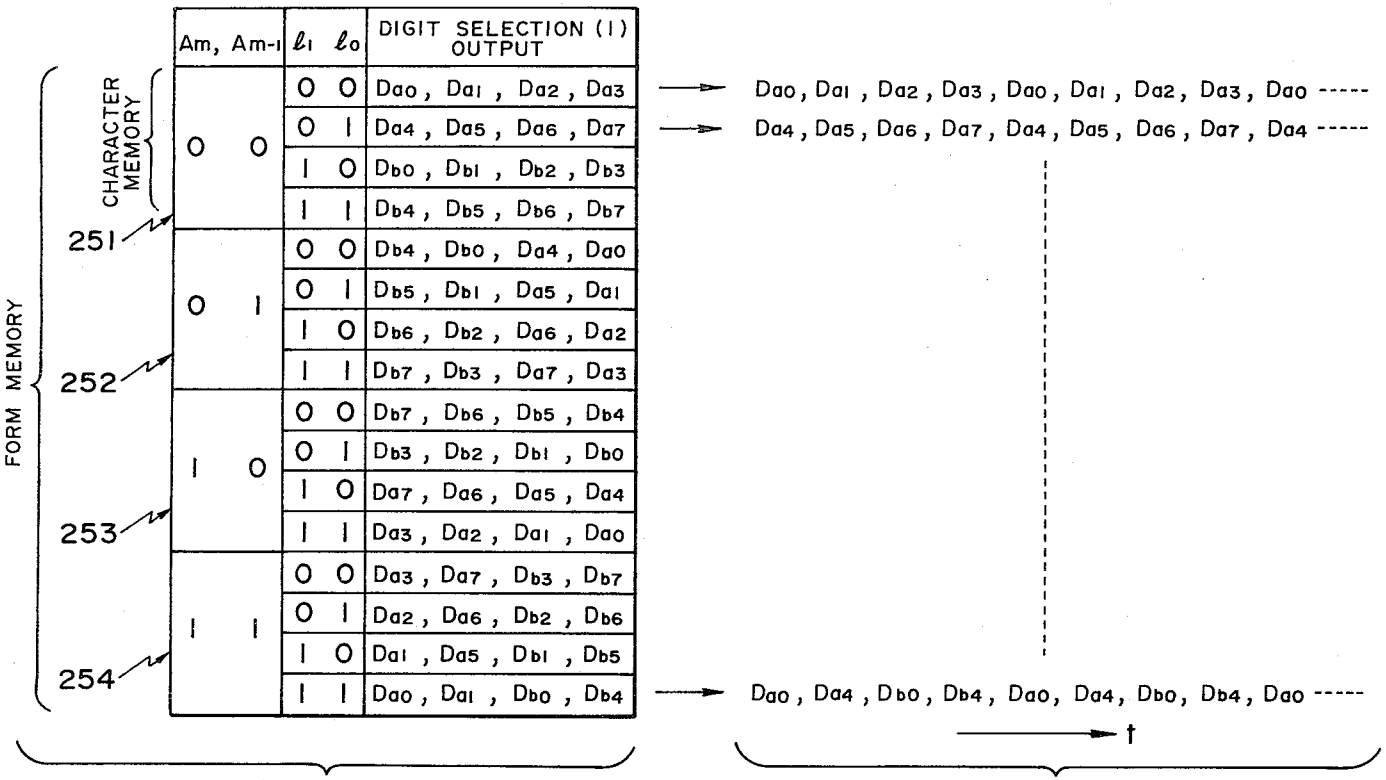
FIGS. 24A and 24B are explanatory views showing digit selectors for character and form memories.

The character digit selector 529 shown in FIG. 20 selects the data of FIG. 15 by 4 bits as shown by 251 in FIG. 24 according to the outputs $L_1L_0$ of the column counter 521.

On the other hand the form digit selector 529' shown in FIG. 20 performs selection in four ways as shown by 251–254 in FIG. 24 according the aforementioned two bits Am and $Am^{-l}$. Each said selection is further selected by 4 bits in four ways according to said outputs $L_1L_0$. In FIG. 23 CA indicates the starting point of the character box access, and CB indicates the order of said access.

FIG. 24 summarizes the function of the character and form digit selectors 531, 531' shown in FIG. 20, which transform the selected 4-bit data A into time-sequential data signals B, which are added in an OR gate 534 shown in FIG. 20 and supplied as a mixed video signal for characters and forms.

As shown in FIG. 24, the selection for characters is limited to the manner 251 but that for forms is conducted in four ways according to the codes Am, $Am^{-1}$.

In this manner, the form symbols (1) to (9) in FIG. 2 required to construct the output form shown in FIG. 1 can be generated only from the form symbols (1), (5) and (7) and the aforementioned object of the present invention can be achieved.

In the foregoing embodiment the forms alone are rotated to four angular degrees while the characters are not rotated, but it is sometimes desirable to rotate the output image alone as shown in FIGS. 25A and 25B without changing the scanning direction of the output. Such requirement can also be fulfilled according to the present invention by constructing the address determining circuit and the digit selector (1) as shown in FIGS. 26 and 27 to provide a signal H/V instructing the longitudinal or lateral mode output.

As explained in the foregoing, the present invention permits reduction of the dimension and cost of the apparatus by generating many required form symbols or form patterns from a minimum necessary number of basic form symbols or form patterns. As many as 1295 kinds required for expressing 6 kinds of form lines such as solid, broken, thick, thin lines etc. can be reduced to 186 kinds of basic patterns, corresponding to a reduction to about 1/7, according to the principle of the present invention combined with practically acceptable conditions. As each pattern is composed of 128 bytes in the foregoing embodiment, said reduction corresponds to a decrease in memory capacity of about 142 Kbytes.

It will be readily understandable that the present invention is by no means limited to the foregoing embodiment but is subject to variations within the scope and spirit of the appended claims.

What I claim is:

1. A pattern generating apparatus, comprising:

form symbol generating means for providing a plurality of basic form symbols and for generating form symbols therefrom;

access means for controlling access of said generating means to generate form symbols different from said plurality of basic form symbols but based on said plurality of basic form symbols; and entry means for entering a select signal for selecting the form symbol to be generated by said generating means, said access means selecting one of said plurality of basic form symbols in response to said select signal and then selecting the read-out sequence of said one basic form symbol thereby to determine the form symbol generated by said generating means.

2. A pattern generating apparatus according to claim 1, wherein said access means is capable of changing the sequence of accessing said basic form symbols from said generating means.

3. A pattern generating apparatus according to claim 1, wherein said form symbol generating means comprises a dot pattern memory for storing dot patterns constituting said basic form symbols.

4. A pattern generating apparatus according to claim 3, wherein said access means is capable of changing the readout sequence of said dot patterns.

5. A pattern generating apparatus according to claim 3, wherein said dot pattern memory comprises a plurality of unit matrixes each of which includes plural simultaneously accessible dot data.

6. A pattern generating apparatus according to claim 5, wherein each of said unit matrixes comprises a plurality of one-bit memories, and wherein said access means is capable of changing the order of access to said unit matrixes and changing the order of access to said one-bit memories in said unit matrixes.

7. A pattern generating apparatus according to claim 5, wherein each said unit matrix has the same number of one-bit memories in the row direction and in the column direction.

8. A pattern generating apparatus according to claim 5, wherein said dot pattern memory has the same number of unit matrixes in the row direction and in the column direction.

9. A pattern generating apparatus according to claim 5 or 7, wherein said unit matrixes have one-bit memories of a number equal to a power of two, both in the row direction and in the column direction.

10. A pattern generating apparatus according to claim 5 or 8, wherein said dot pattern memory has unit matrixes of a number equal to a power of two, both in the row direction and in the column direction.

11. A pattern generating apparatus, comprising:

a dot pattern memory for storing a plurality of dot patterns constituting a plurality of basic form symbols;

changing means for changing the read-out sequence of said dot patterns from said dot pattern memory for providing plural kinds of form symbols by rotation of said basic form symbols; and entry means for entering a select signal for selecting a form symbol, said changing means selecting the read-out sequence of dot patterns from said dot pattern memory in response to said select signal to determine the form symbol read-out.

12. A pattern generating apparatus according to claim 11, wherein said dot pattern memory comprises a plurality of unit matrixes each of which includes plural simultaneously accessible dot data.

13. A pattern generating apparatus according to claim 12, wherein said changing means is capable of changing the readout sequence of said matrixes, and changing the readout sequence of said dot data in said unit matrix.

14. A pattern generating apparatus, comprising:

a dot pattern memory for storing a plurality of dot patterns constituting a plurality of basic form symbols, said dot pattern memory being comprised of plural unit matrixes each storing plural dots;

first selecting means for sequentially selecting said unit matrixes;

second selecting means for sequentially selecting said plural dots;

control means for controlling the sequence of selection by said first and second selecting means according to a desired rotational angle to said basic form symbols; and entry means for entering a select signal for selecting a form symbol, said control means selecting one of said basic form symbols in response to said select signal and then determining the read-out sequence by said first selecting means of the one unit matrix representing said one basic form symbol and the read-out sequence by said second selecting means of said plural dots in said one unit matrix thereby to determine the selected form symbol.

15. A pattern generating apparatus according to claim 14, further comprising:

a row counter for counting row clock signals indicating the recording position in an auxiliary scanning direction; and a column counter for counting column clock signals indicating the recording position in a principal scanning direction.

16. A pattern generating apparatus according to claim 15, wherein said first selecting means is adapted to sequentially select said unit matrixes in response to the output signals of said row counter and column counter.

17. A pattern generating apparatus according to claim 16, wherein said second selecting means is adapted to sequentially select said plural dots in response to the output signals of said row counter and column counter.

18. A pattern generating apparatus according to claim 16, wherein said first selecting means is adapted to sequentially select said unit matrixes in response to the upper digit bits of the output signals of said row counter and column counter.

19. A pattern generating apparatus according to the claim 16, wherein said second selecting means is adapted to sequentially select said plural dots in response to the lower digit bits of the output signals of said row counter and column counter.

20. A pattern generating apparatus according to the claim 1, 11 or 14, wherein said basic form symbols are composed of linear patterns.

21. A pattern generating apparatus according to the claim 1, 11 or 14, wherein said basic form symbols are composed of L-shaped patterns.

22. A pattern generating apparatus according to claim 1, 11 or 14, wherein said basic form symbols are composed of solid lines.

23. A pattern generating apparatus according to claim 1, 11 or 14, wherein said basic form symbols are composed of lines of at least two different thicknesses.

24. A pattern generating apparatus according to claim 1, wherein said access means is capable of changing the access sequence of said basic form symbols to form plural kinds of form symbols by rotation of said basic form symbols.

25. A pattern generating apparatus, comprising:

form symbol generating means for storing a plurality of basic form symbols and for generating form symbols therefrom;

forming means for forming form symbols different from said basic form symbols by rotational control of said basic form symbols as generated by said generating means; and entry means for entering a select signal for selecting a form symbol, said forming means selecting one of said plurality of basic form symbols in response to said select signal and then selecting the read-out sequence of said one basic form symbol thereby to determine the form symbol generated by said generating means.

26. A pattern generating apparatus according to claim 25, wherein said forming means is capable of forming the form symbols different from said basic form symbols by controlling an access sequence of said basic form symbols.

27. A pattern generating apparatus according to claim 26, wherein form symbol generating means is composed of a dot pattern memory for storing dot patterns constituting said basic form symbols.

28. A pattern generating apparatus according to claim 27, wherein said access means is capable of changing the readout sequence of said dot patterns.

* * * * *

UNITED STATES PATENT AND TRADEMARK OFFICE

CERTIFICATE OF CORRECTION

PATENT NO. :4,486,745

DATED :December 4, 1984

INVENTOR(S) : AKIRA KONNO

It is certified that error appears in the above-identified patent and that said Letters Patent is hereby corrected as shown below:

Column 1

Line 39, change "form symbols" to --symbols--,

Line 40, change "625, form symbols" to --625 form symbols,--.

Column 2

Line 37, delete "combination",

Line 58, change "if" to --of--.

Column 3

Line 36, change "4(n-1)hu2," to --$4(n-1)^2$,--.

Column 5

Lines 46 and 47, change "a (110a)" to --A(110a)--,

Line 60, insert --to-- between "correspond" and "the".

UNITED STATES PATENT AND TRADEMARK OFFICE

CERTIFICATE OF CORRECTION

PATENT NO. : 4,486,745

DATED : December 4, 1984

INVENTOR(S) : AKIRA KONNO

It is certified that error appears in the above-identified patent and that said Letters Patent is hereby corrected as shown below:

Column 7

Line 51, after "8 bits" insert --constituting a--,

Line 52, before "forms" insert --characters and another set of 16 bits for--.

Signed and Sealed this

*Thirty-first* Day of *December 1985*

[SEAL]

*Attest:*

DONALD J. QUIGG

*Attesting Officer*

*Commissioner of Patents and Trademarks*